US010569569B2

(12) United States Patent
Taga et al.

(10) Patent No.: US 10,569,569 B2
(45) Date of Patent: Feb. 25, 2020

(54) IMAGE FORMING METHOD AND INK-JET RECORDING APPARATUS

(71) Applicant: Brother Kogyo Kabushiki Kaisha, Nagoya-shi, Aichi-ken (JP)

(72) Inventors: Yasuhiro Taga, Kani (JP); Keisuke Yuhara, Nagoya (JP); Mitsunori Maeda, Nagoya (JP); Shinpei Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/937,367

(22) Filed: Mar. 27, 2018

(65) Prior Publication Data

US 2019/0100037 A1 Apr. 4, 2019

(30) Foreign Application Priority Data

Sep. 29, 2017 (JP) ..... 2017-192143

(51) Int. Cl.

| | |
|---|---|
| ***B41J 11/00*** | (2006.01) |
| ***D06P 5/30*** | (2006.01) |
| ***B41M 5/00*** | (2006.01) |
| ***D06P 5/22*** | (2006.01) |
| ***B41J 3/407*** | (2006.01) |
| ***D06P 1/44*** | (2006.01) |
| ***D06P 1/52*** | (2006.01) |
| ***B41J 2/21*** | (2006.01) |
| ***D06P 5/00*** | (2006.01) |
| *B41M 7/00* | (2006.01) |

(52) U.S. Cl.

CPC ..... *B41J 11/0015* (2013.01); *B41J 2/2107* (2013.01); *B41J 3/4078* (2013.01); *B41M 5/0017* (2013.01); *D06P 1/44* (2013.01); *D06P 1/5285* (2013.01); *D06P 5/002* (2013.01); *D06P 5/225* (2013.01); *D06P 5/30* (2013.01); *B41M 5/0047* (2013.01); *B41M 7/009* (2013.01); *B41M 7/0018* (2013.01)

(58) Field of Classification Search

CPC ..... C09D 11/30; C09D 11/54; B41J 11/0015; D06P 5/225; D06P 5/30; B41M 5/0017

USPC ..... 347/95, 100, 101, 105, 106

See application file for complete search history.

(56) References Cited

U.S. PATENT DOCUMENTS

| | | | |
|---|---|---|---|
| 5,609,671 | A | 3/1997 | Nagasawa |
| 5,837,045 | A | 11/1998 | Johnson et al. |
| 6,705,717 | B1 | 3/2004 | Fujita et al. |

(Continued)

FOREIGN PATENT DOCUMENTS

| | | | |
|---|---|---|---|
| EP | 2907670 | A2 | 8/2015 |
| JP | H08-003498 | A | 1/1996 |

(Continued)

OTHER PUBLICATIONS

Oct. 25, 2018—(EP) Extended Search Report—App 18164381.8.

*Primary Examiner* — An H Do

(74) *Attorney, Agent, or Firm* — Banner & Witcoff, Ltd.

(57) ABSTRACT

An image forming method uses an apparatus for forming an image on both recording media of fabric and recording paper. The image forming method includes: applying a treatment agent to the fabric, the treatment agent coagulating a water-based ink or increasing viscosity of the water-based ink; and discharging the water-based ink onto the fabric by an ink-jet system, the water-based ink being identical to a water-based ink used for forming the image on the recording paper.

18 Claims, 6 Drawing Sheets

(56) References Cited

U.S. PATENT DOCUMENTS

| | | | |
|---|---|---|---|
| 8,016,404 | B2 | 9/2011 | Kato et al. |
| 2006/0201380 | A1 | 9/2006 | Kowalski et al. |
| 2007/0100023 | A1 | 5/2007 | Burns et al. |
| 2007/0100024 | A1 | 5/2007 | Gu et al. |
| 2008/0241398 | A1 | 10/2008 | Kato et al. |
| 2009/0229489 | A1 | 9/2009 | Gu |
| 2012/0229558 | A1 | 9/2012 | Nishizaki et al. |
| 2014/0125731 | A1 | 5/2014 | Katsuragi |
| 2015/0251444 | A1 | 9/2015 | Sayama et al. |

FOREIGN PATENT DOCUMENTS

| | | | |
|---|---|---|---|
| JP | H08-39793 | A | 2/1996 |
| JP | 2000-513396 | A | 10/2000 |
| JP | 2008-524400 | A | 7/2008 |
| JP | 2008-246821 | A | 10/2008 |
| JP | 2009-515007 | A | 4/2009 |
| JP | 2011-515535 | A | 5/2011 |
| JP | 2015-168147 | A | 9/2015 |
| JP | 2016-89288 | A | 5/2016 |
| WO | 2010027078 | A1 | 3/2010 |
| WO | 2014039306 | A1 | 3/2014 |

IMAGE FORMING METHOD AND INK-JET RECORDING APPARATUS

CROSS REFERENCE TO RELATED APPLICATION

The present application claims priority from Japanese Patent Application No. 2017-192143, filed on Sep. 29, 2017, the disclosure of which is incorporated herein by reference in its entirety.

BACKGROUND OF THE INVENTION

Field of the Invention

The present invention relates to an image forming method and an ink-jet recording apparatus.

Description of the Related Art

Various types of printing apparatuses have been suggested, which have a paper medium printing mode for executing the printing on a paper medium and a textile printing mode for executing the printing on a fabric medium and which make it possible to perform the printing on both of the paper medium and the fabric medium (for example, Japanese Patent Application Laid-open No. 2015-168147 corresponding to United States Patent Application Publication No. 2015/0251444).

However, in general, the cloth or fabric is washed with water. On this account, the printed matter formed on the fabric is required to be excellent in the fastness against water.

SUMMARY OF THE INVENTION

In view of the above, an object of the present teaching is to provide an image forming method which makes it possible to improve the fastness against water (water resistance) in relation to printed matter formed on fabric and which makes it possible to form an image on recording paper as well.

According to a first aspect of the present teaching, there is provided an image forming method using an apparatus for forming an image on both recording media of fabric and recording paper, the image forming method including: applying a treatment agent to the fabric, the treatment agent coagulating a water-based ink or increasing viscosity of the water-based ink; and discharging the water-based ink onto the fabric by an ink-jet system, the water-based ink being identical to a water-based ink used for forming the image on the recording paper.

According to a second aspect of the present teaching, there is provided an ink-jet recording apparatus used for the image forming method according to the first aspect; the ink-jet recording apparatus including an ink set accommodating unit which accommodates an ink set including the water-based ink and the treatment agent; an ink-jet head constructed to discharge the water-based ink onto the recording medium; and a treatment agent applying mechanism constructed to apply the treatment agent to the recording medium.

DESCRIPTION OF THE PREFERRED EMBODIMENTS

[Image Forming Method]

Figure 1:
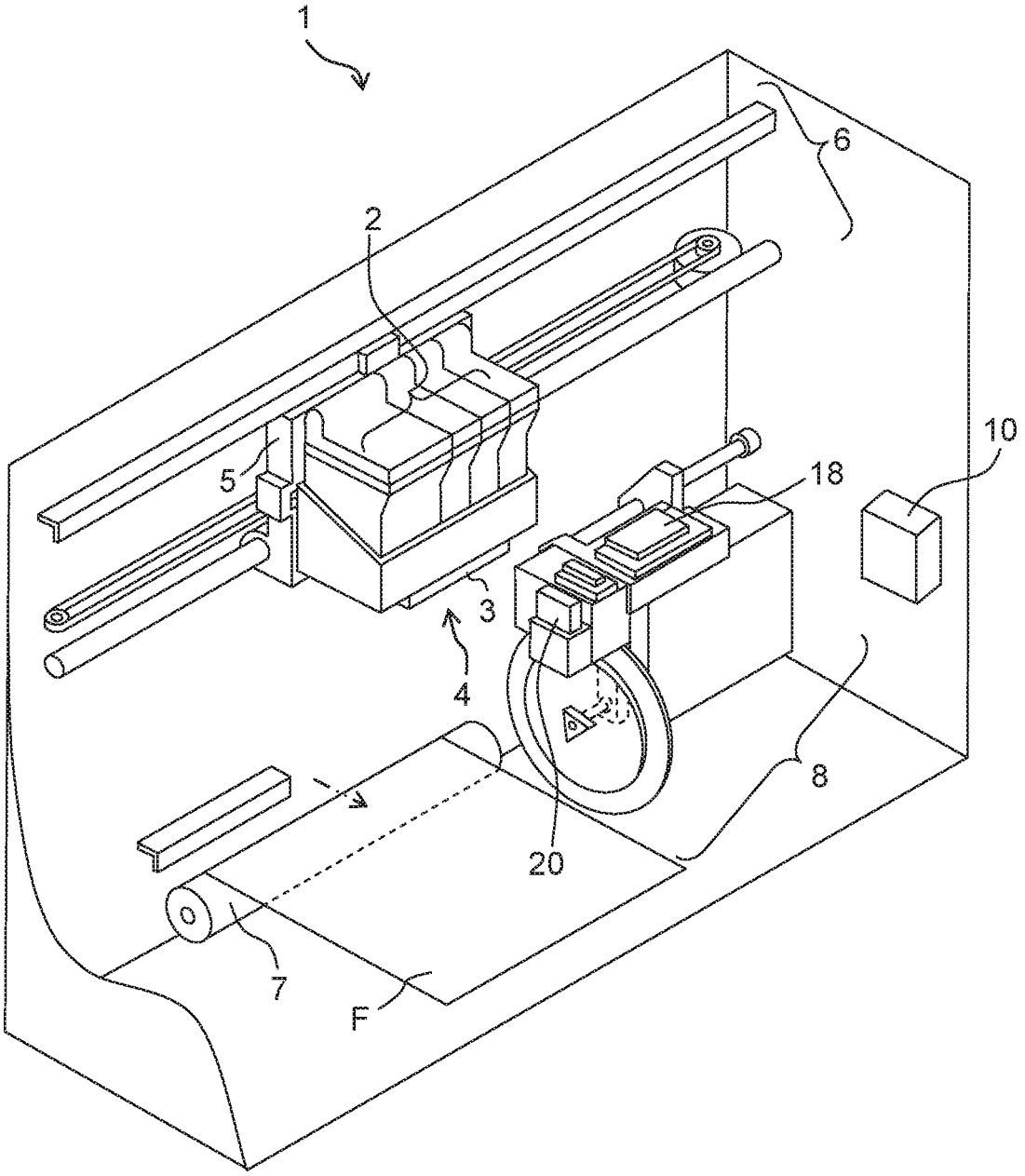
FIG. 1 shows a schematic perspective view illustrating an exemplary structure of an ink-jet recording apparatus of the present teaching.

The image forming method of the present teaching will be explained. The image forming method of the present teaching resides in an image forming method for forming an image on a recording medium including fabric and recording paper by using a water-based ink, and the image forming method includes an image printing step. The fabric includes both of knit and textile. The material of the fabric may be either natural fiber or synthetic fiber. The natural fiber is exemplified, for example, by cotton and silk. The synthetic fiber is exemplified, for example, by urethane, acrylic, polyester, and nylon.

The printing step is a step of printing the image by discharging the water-based ink onto the recording medium by means of the ink-jet system.

The water-based ink contains, for example, a colorant and water.

The colorant includes, for example, anionic colorants. The anionic colorant may be either a pigment or a dye. Further, the pigment and the dye may be mixed and used as the anionic colorant.

The pigment, which is usable as the anionic colorant described above, is not specifically limited, for which it is possible to exemplify, for example, carbon black, an inorganic pigment, an organic pigment, etc. The carbon black is exemplified, for example, by furnace black, lamp black, acetylene black, channel black, etc. The inorganic pigment can be exemplified, for example, by titanium oxide, inorganic pigments based on iron oxide, inorganic pigments based on carbon black, etc. The organic pigment is exemplified, for example, by azo-pigments such as azo lake, insoluble azo-pigment, condensed azo-pigment, chelate azo-pigment, etc.; polycyclic pigments such as phthalocyanine pigment, perylene and perynon pigments, anthraquinone pigment, quinacridone pigment, dioxadine pigment, thioindigo pigment, isoindolinone pigment, quinophthalone pigment etc.; lake pigments such as basic dye type lake pigment, acid dye type lake pigment etc.; nitro pigments; nitroso pigments; aniline black daylight fluorescent pigment; and the like. Any other pigment can be also used provided that the pigment is dispersible in the water phase. Specified examples of such pigments are also exemplified, for example, by C. I. Pigment Blacks 1, 6, and 7; C. I. Pigment Yellows 1, 2, 3, 12, 13, 14, 15, 16, 17, 55, 73, 74, 75, 78, 83, 93, 94, 95, 97, 98, 114, 128, 129, 138, 150, 151, 154, 180, 185, and 194; C. I. Pigment Oranges 31 and 43; C. I. Pigment Reds 2, 3, 5, 6, 7, 12, 15, 16, 48, 48:1, 53:1, 57, 57:1, 112, 122, 123, 139, 144, 146, 149, 150, 166, 168, 175, 176, 177, 178, 184, 185, 190, 202, 221, 222, 224, and 238; C. I. Pigment Violet 19, 196; C. I. Pigment Blues 1, 2, 3, 15, 15:1, 15:2, 15:3, 15:4, 16, 22, and 60; C. I. Pigment Greens 7 and 36; as well as solid solutions thereof; and the like. One kind of the pigment as described above may be used singly, or two or more kinds of the pigments as described above may be used in combination.

The pigment, which is usable as the anionic colorant described above, is also exemplified by self-dispersible pigments. The self-dispersible pigment is dispersible in water without using any dispersing agent, for example, owing to the fact that at least one of the hydrophilic functional group and the salt thereof including, for example, a carbonyl group, a hydroxyl group, a carboxylic acid group, a sulfonic acid group, and a phosphoric acid group is introduced into the particles of the pigment by the chemical bond directly or with any group intervening therebetween. As the self-dispersible pigment, it is possible to use a self-dispersible pigment in which the pigment is subjected to a treatment by any one of methods described, for example, in Japanese Patent Application Laid-open No. 8-3498 corresponding to U.S. Pat. No. 5,609,671, Published Japanese Translation of PCT International Publication for Patent Application No. 2000-513396 corresponding to U.S. Pat. No. 5,837,045, Published Japanese Translation of PCT International Publication for Patent Application No. 2008-524400 corresponding to United States Patent Application Publication No. 2006/0201380, Published Japanese Translation of PCT International Publication for Patent Application No. 2009-515007 corresponding to United States Patent Application Publication Nos. 2007/0100024 and 2007/0100023, Published Japanese Translation of PCT International Publication for Patent Application No. 2011-515535 corresponding to United States Patent Application Publication No. 2009/0229489, etc. It is possible to use, as a material for the self-dispersible pigment, for example, any one of the inorganic pigment and the organic pigment. Further, as the pigment which is suitable to perform the treatment as described above, carbon blacks are exemplified, including, for example, "MA8", "MA100" and "#2650" produced by Mitsubishi Chemical Corporation, and "Carbon Black FW200" produced by Degussa, etc. As the self-dispersible pigment, it is also allowable to use, for example, any commercially available product. The commercially available product includes, for example, "CAB-O-JET (trade name) 200", "CAB-O-JET (trade name) 250C", "CAB-O-JET (trade name) 260M", "CAB-O-JET (trade name) 270Y", "CAB-O-JET (trade name) 300", "CAB-O-JET (trade name) 400", "CAB-O-JET (trade name) 450C", "CAB-O-JET (trade name) 465M", and "CAB-O-JET (trade name) 470Y" produced by CABOT CORPORATION; "BONJET (trade name) BLACK CW-2" and "BONJET (trade name) BLACK CW-3" produced by Orient Chemical Industries, Ltd.; and "LIOJET (trade name) WD BLACK 002C" produced by Toyo Ink Mfg. Co., Ltd.

The dye, which is usable as the anionic colorant described above, is not specifically limited. The dye is exemplified, for example, by direct dyes, acid dyes, reactive dyes, food dyes, etc.

The direct dye is not specifically limited, which is exemplified, for example, by C. I. Direct Black, C. I. Direct Blue, C. I. Direct Red, C. I. Direct Yellow, C. I. Direct Orange, C. I. Direct Violet, C. I. Direct Brown, and C. I. Direct Green. C. I. Direct Black described above is exemplified, for example, by C. I. Direct Blacks 17, 19, 22, 31, 32, 51, 62, 71, 74, 108, 112, 113, 146, 154, 168, and 195. C. I. Direct Blue described above is exemplified, for example, by C. I. Direct Blues 1, 6, 15, 22, 25, 41, 71, 76, 77, 80, 86, 90, 98, 106, 108, 120, 158, 163, 168, 199, and 226. C. I. Direct Red described above is exemplified, for example, by C. I. Direct Reds 1, 2, 4, 9, 11, 17, 20, 23, 24, 28, 31, 39, 46, 62, 75, 79, 80, 83, 89, 95, 197, 201, 218, 220, 224, 225, 226, 227, 228, 229, and 230. C. I. Direct Yellow described above is exemplified, for example, by C. I. Direct Yellows 8, 11, 12, 24, 26, 27, 28, 33, 39, 44, 50, 58, 85, 86, 87, 88, 89, 98, 100, 110, 132, 142, and 173. C. I. Direct Orange described above is exemplified, for example, by C. I. Direct Oranges 34, 39, 44, 46, and 60. C. I. Direct Violet described above is exemplified, for example, by C. I. Direct Violets 47 and 48. C. I. Direct Brown described above is exemplified, for example, by C. I. Direct Brown 109. C. I. Direct Green described above is exemplified, for example, by C. I. Direct Green 59.

The acid dye is not specifically limited, which is exemplified, for example, by C. I. Acid Black, C. I. Acid Blue, C. I. Acid Red, C. I. Acid Yellow, C. I. Acid Orange, and C. I. Acid Violet. C. I. Acid Black described above is exemplified, for example, by C. I. Acid Blacks 2, 7, 24, 26, 31, 48, 51, 52, 63, 110, 112, 115, 118, and 156. C. I. Acid Blue described above is exemplified, for example, by C. I. Acid Blues 1, 7, 9, 15, 22, 23, 25, 29, 40, 43, 59, 62, 74, 78, 80, 90, 93, 100, 102, 104, 117, 120, 127, 138, 158, 161, 167, 220, and 234. C. I. Acid Red described above is exemplified, for example, by C. I. Acid Reds 1, 6, 8, 9, 13, 14, 18, 26, 27, 32, 35, 37, 42, 51, 52, 80, 83, 85, 87, 89, 92, 94, 106, 114, 115, 133, 134, 145, 158, 180, 198, 249, 256, 265, 289, 315, and 317. C. I. Acid Yellow described above is exemplified, for example, by C. I. Acid Yellows 1, 3, 7, 11, 17, 23, 25, 29, 36, 38, 40, 42, 44, 61, 71, 76, 98, and 99. C. I. Acid Orange described above is exemplified, for example, by C. I. Acid Oranges 7 and 19. C. I. Acid Violet described above is exemplified, for example, by C. I. Acid Violet 49.

The reactive dye is not specifically limited, which is exemplified, for example, by C. I. Reactive Blue, C. I. Reactive Red, and C. I. Reactive Yellow. C. I. Reactive Blue described above is exemplified, for example, by C. I. Reactive Blues 4, 5, 7, 13, 14, 15, 18, 19, 21, 26, 27, 29, 32, 38, 40, 44, and 100. C. I. Reactive Red described above is exemplified, for example, by C. I. Reactive Reds 7, 12, 13, 15, 17, 20, 23, 24, 31, 42, 45, 46, and 59. C. I. Reactive Yellow described above is exemplified, for example, by C. I. Reactive Yellows 2, 3, 17, 25, 37, and 42.

The food dye is not specifically limited, which is exemplified, for example, by C. I. Food Black, C. I. Food Red, and C. I. Food Yellow. C. I. Food Black described above is exemplified, for example, by C. I. Food Blacks 1 and 2. C. I. Food Red described above is exemplified, for example, by C. I. Food Reds 87, 92, and 94. C. I. Food Yellow described above is exemplified, for example, by C. I. Food Yellow 3.

The blending amount of the colorant with respect to the entire amount of the water-based ink is, for example, in a range of 0.1% by weight to 20% by weight, in a range of 1% by weight to 15% by weight, or in a range of 2% by weight to 10% by weight. Note that when the colorant is the pigment, the blending amount of the colorant is, for example, the pigment solid content amount.

The water contained in the water-based ink is preferably ion-exchange water or purified water (pure water). The blending amount of the water with respect to the entire amount of the water-based ink may be, for example, a balance of the other components.

The water-based ink may further contain a water-soluble organic solvent. The water-soluble organic solvent contained in the water-based ink is exemplified, for example, by a humectant which prevents the water-based ink from drying at an end of a nozzle in an ink-jet head, a penetrant which adjusts the drying velocity on a recording medium, etc.

The humectant is not particularly limited, and is exemplified, for example, by lower alcohols such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketones such as acetone; ketoalcohols (ketone alcohols) such as diacetone alcohol; ethers such as tetrahydrofuran and dioxane; polyethers such as polyalkylene glycol; polyvalent alcohols such as alkylene glycol, glycerol, trimethylolpropane, trimethylolethane, etc.; 2-pyrrolidone; N-methyl-2-pyrrolidone; 1,3-dimethyl-2-imidazolidinone; and the like. The polyalkylene glycol is exemplified, for example, by polyethylene glycol, polypropylene glycol, etc. The alkylene glycol is exemplified, for example, by ethylene glycol, propylene glycol, butylene glycol, diethylene glycol, triethylene glycol, dipropylene glycol, tripropylene glycol, thiodiglycol, hexylene glycol, etc. It is allowable that one kind of the humectant as described above is used singly, or two or more kinds of the humectant are used in combination. Among the above-described humectants, the humectant is preferably a polyvalent alcohol such as alkylene glycol, glycerol, etc.

The blending amount of the humectant with respect to the entire amount of the water-based ink is, for example, in a range of 0% by weight to 95% by weight, in a range of 5% by weight to 80% by weight, or in a range of 5% by weight to 50% by weight.

The penetrant is exemplified, for example, by glycol ether. The glycol ether is exemplified, for example, by ethylene glycol methyl ether, ethylene glycol ethyl ether, ethylene glycol-n-propyl ether, diethylene glycol methyl ether, diethylene glycol ethyl ether, diethylene glycol-n-propyl ether, diethylene glycol-n-butyl ether, diethylene glycol-n-hexyl ether, triethylene glycol methyl ether, triethylene glycol ethyl ether, triethylene glycol-n-propyl ether, triethylene glycol-n-butyl ether, propylene glycol methyl ether, propylene glycol ethyl ether, propylene glycol-n-propyl ether, propylene glycol-n-butyl ether, dipropylene glycol methyl ether, dipropylene glycol ethyl ether, dipropylene glycol-n-propyl ether, dipropylene glycol-n-butyl ether, tripropylene glycol methyl ether, tripropylene glycol ethyl ether, tripropylene glycol-n-propyl ether, tripropylene glycol-n-butyl ether, etc. One kind of the penetrant may be used singly, or two or more kinds of the penetrant may be used in combination.

The blending amount of the penetrant with respect to the entire amount of the water-based ink is, for example, in a range of 0% by weight to 20% by weight, in a range of 0% by weight to 15% by weight, or in a range of 1% by weight to 4% by weight.

The water-based ink may further contain a conventionally known additive, as necessary. The additive is exemplified, for example, by surfactants, pH-adjusting agents, viscosity-adjusting agents, surface tension-adjusting agents, fungicides, etc. The viscosity-adjusting agents are exemplified, for example, by polyvinyl alcohol, cellulose, water-soluble resin, etc.

The water-based ink can be prepared, for example, by uniformly mixing the colorant and water, and an optionally other additive(s) as necessary, by a conventionally known method, and then removing any non-dissolved matter, with a filter, etc.

The image printing step described above can be carried out, for example, by using an ink-jet recording apparatus (an apparatus for forming an image) of the present teaching shown in FIG. 1. As shown in FIG. 1, the ink-jet recording apparatus 1 includes, as main constitutive components, four ink cartridges (ink containers) 2, an ink discharge mechanism (ink-jet head) 3, a head unit 4, a carriage 5, a driving unit 6, a platen roller 7, and a purge device 8. Further, the ink-jet recording apparatus 1 is provided with a control mechanism (controller 10) which has, for example, CPU, ROM, and RAM to control respective portions of the ink-jet recording apparatus. Although not shown in FIG. 1, the ink-jet recording apparatus 1 may further include, at appropriate positions, a treatment agent applying mechanism and a drying mechanism.

Each of the four ink cartridges 2 contains one color of each of four colors of water-based inks of yellow, magenta, cyan, and black. For example, at least one of the four color water-based inks is the water-based ink used for the image forming method of the present teaching. In this exemplary embodiment, a set of the four ink cartridges 2 are shown. However, in place thereof, it is also allowable to use an integrated type ink cartridge in which the interior thereof is comparted so that a yellow ink accommodating portion, a magenta ink accommodating portion, a cyan ink accommodating portion, and a black ink accommodating portion are formed. For example, those conventionally known can be used as a main body of the ink cartridge.

The ink-jet head 3, which is installed for the head unit 4, performs the recording (image printing) on the recording medium (for example, fabric F). Note that the recording medium may be any recording medium such as recording paper or the like other than the fabric F. The four ink cartridges 2 and the head unit 4 are carried on the carriage 5. The driving unit 6 reciprocatively moves the carriage 5 in the straight line direction. For example, those conventionally known can be used as the driving unit 6 (see, for example, Japanese Patent Application Laid-open No. 2008-246821 corresponding to United States Patent Application Publication No. 2008/0241398). The platen roller 7 extends in the reciprocating direction of the carriage 5, and the platen roller 7 is arranged opposingly to the ink-jet head 3.

The purge device 8 sucks any defective ink containing, for example, bubbles accumulated in the ink-jet head 3. For example, those conventionally known can be used as the purge device 8 (see, for example, Japanese Patent Application Laid-open No. 2008-246821 corresponding to United States Patent Application Publication No. 2008/0241398).

A wiper member 20 is arranged adjacently to the purge device 8 on the platen roller 7 side of the purge device 8. The wiper member 20 is formed to have a spatula-shaped form. The wiper member 20 wipes out the nozzle-formed surface of the ink-jet head 3 in accordance with the movement of the carriage 5. With reference to FIG. 1, a cap 18 covers a plurality of nozzles of the ink-jet head 3 which is to be returned to the reset position when the recording (image printing) is completed, in order to prevent the water-based inks from being dried.

In the ink-jet recording apparatus 1 of this embodiment, the four ink cartridges (liquid containers) 2 are carried on one carriage 5 together with the head unit 4. However, the present teaching is not limited thereto. In the ink-jet recording apparatus 1, each of the cartridges of the four ink cartridges 2 may be carried on any carriage distinct from the head unit 4. Alternatively, it is also allowable that the respective cartridges of the four ink cartridges 2 are not carried on the carriage 5, and they are arranged and fixed in the ink-jet recording apparatus. In the embodiments as described above, for example, the respective cartridges of the four ink cartridges 2 are connected to the head unit 4 carried on the carriage 5, for example, by means of tubes or the like, and the water-based inks are supplied from the respective cartridges of the four ink cartridges 2 to the head unit 4. Further, in the embodiments as described above, four ink bottles having bottle-shaped forms may be used in place of the four ink cartridges 2. In this case, it is preferable that the ink bottle is provided with an injection port for injecting the ink into the inside from the outside.

The image printing, which is based on the use of the ink-jet recording apparatus 1, is carried out, for example, as follows. At first, the recording medium (for example, fabric or the like) F is supplied from a supply tray (not shown) provided at a side portion or a lower portion of the ink-jet recording apparatus 1. The recording medium F is introduced into the space between the ink-jet head 3 and the platen roller 7. The predetermined recording (image printing) is performed on the introduced recording medium F by means of the water-based inks discharged from the ink-jet head 3. In this procedure, the identical chromatic color ink, which is included in the water-based inks described above, is used irrelevant to the type or kind of the recording medium F. As for the achromatic color ink included in the water-based inks, the identical ink or different inks may be used, for example, for the fabric F and any recording medium such as recording paper or the like other than the fabric F. The identical ink discharged onto the fabric may be, for example, an ink provided from the liquid container (the ink cartridge or the ink bottle) in which the ink to be discharged onto the recording paper is contained. When different achromatic color inks are used for the fabric F and the recording medium such as the recording paper or the like other than the fabric F, the ink-jet recording apparatus 1 may be provided with an achromatic color ink for the fabric F and an achromatic color ink for the recording medium such as the recording paper or the like other than the fabric F. The recording medium F after the recording (image printing) is discharged from the ink-jet recording apparatus 1. A supply mechanism and a discharge mechanism for the recording medium F are omitted from the illustration in FIG. 1.

The apparatus shown in FIG. 1 adopts the serial type ink-jet head. However, the present teaching is not limited thereto. The ink-jet recording apparatus may be an apparatus which adopts a line type ink-jet head.

The image forming method of the present teaching further includes the treatment agent applying step when the recording medium is the fabric. Note that in the image forming method of the present teaching, when the recording medium is, for example, any recording medium such as the recording paper or the like other than the fabric, the execution of the treatment agent applying step is arbitrary. The treatment agent applying step may be either carried out or not carried out. For example, the image forming method of the present teaching may be such a method that only the image printing step is carried out when the recording medium is any recording medium other than the fabric.

The treatment agent applying step is the step of applying the treatment agent to the fabric. If this step is carried out when the recording medium is any recording medium other than the fabric, then the treatment agent is applied to the recording medium other than the fabric in place of the fabric in this step. The timing, at which the treatment agent applying step is carried out, is not restricted. For example, the treatment agent may be applied prior to the discharge of the water-based ink onto the recording medium. The water-based ink may be previously discharged onto the recording medium, and then the treatment agent may be applied. The application of the treatment agent to the recording medium and the discharge of the water-based ink may be performed simultaneously.

The treatment agent contains, for example, a cationic substance.

The cationic substance is not specifically limited. It is possible to exemplify, for example, cationic polymers, cationic inorganic fine particles, cationic surfactants, polyvalent metal salts, and polyvalent metal ions. Among them, the cationic polymer, the cationic inorganic fine particles, and the cationic surfactant are preferred, and the cationic polymer and the cationic inorganic fine particles are more preferred.

The cationic polymer is exemplified, for example, by a cationic polymer containing the urethane structure, polyamine, polyallylamine, polyethyleneimine, polyvinylamine, polyvinylpyridine, polyethyleneimine-epichlorohydrin reaction product, polyamide-polyamine resin, polyamide-epichlorohydrin resin, cationic starch, polyvinyl alcohol, polyvinylpyrrolidone, polyamidine, cationic epoxy resin, polyacrylamide, polyacrylic acid ester, polymethacrylic acid ester, polyvinyl formamide, aminoacetalized polyvinyl alcohol, polyvinyl benzyl onium, dicyandiamide-formalin polycondensate, dicyandiamide-diethylenetriamine polycondensate, epichlorohydrin-dimethylamine addition polymer, dimethyldiallylammonium chloride-$SO_2$ copolymer, dimethyldiallylammonium chloride polymer, and derivatives thereof. Further, the cationic polymer described above is also exemplified, for example, by a polymer of single monomer or a copolymer of a plurality of monomers composed of at least one of water-soluble monomers including, for example, dimethylaminoethyl methacrylate (DM), methacryloyloxyethyl trimethyl ammonium chloride (DMC), methacryloyloxyethyl benzyl dimethyl ammonium chloride (DMBC), dimethylaminoethyl acrylate (DA), acryloyloxyethyl trimethyl ammonium chloride (DMQ), acryloyloxyethyl benzyl dimethyl ammonium chloride (DABC), dimethylaminopropyl acrylamide (DMAPAA), and acrylamide propyl trimethyl ammonium chloride (DMAPAAQ). Among them, the cationic polymer containing the urethane structure, polyallylamine, and polyethyleneimine are preferred. The cationic polymer containing the urethane structure is more preferred. When the cationic polymer is an emulsion, the minimum film formation temperature (minimum film-forming temperature) of the cationic polymer is preferably not more than 25° C. The minimum film formation temperature can be measured based on, for example, JIS K 6828-2, ISO 2115, Plastics-Polymer dispersions-Determination of white point temperature and minimum film-forming temperature.

The cationic polymer containing the urethane structure may contain a cationic unit including, for example, organic amine and the like together with the urethane structure described above. It is allowable to privately prepare the cationic polymer containing the urethane structure in-house. Alternatively, it is also allowable to use a commercially available product.

The weight average molecular weight of the cationic polymer containing the urethane structure is, for example, 1000 to 500000 or 3000 to 500000. Note that when the cationic polymer containing the urethane structure is an emulsion as described later on, the weight average molecular weight is the weight average molecular weight of the solid content of the emulsion.

In the cationic polymer containing the urethane structure, it is preferable that the ratio of occupation of the urethane structure portion is not less than 10% by weight, and it is more preferable that the ratio is not less than 20% by weight. Note that when the cationic polymer containing the urethane structure is an emulsion as described later on, the ratio of occupation of the urethane structure portion is the ratio of occupation of the urethane structure portion in the solid content of the emulsion.

The cationic polymer containing the urethane structure preferably contains at least one of the acrylic structure and the styrene structure at any portion other than the urethane structure. More preferably, the cationic polymer containing the urethane structure contains the acrylic structure.

The cationic polymer containing the urethane structure may be, for example, an emulsion (urethane emulsion). Namely, the treatment agent may contain an emulsion of the cationic polymer including the urethane structure (urethane emulsion).

The cationic polymer containing the urethane structure is, for example, the emulsion, and the cationic polymer containing the urethane structure preferably contains at least one of the acrylic structure and the styrene structure at any portion other than the urethane structure. More preferably, the cationic polymer containing the urethane structure contains the acrylic structure (cationic polymer is the urethane acrylic emulsion). Commercially available products of the urethane acrylic emulsion are exemplified, for example, by "Mowinyl (trade name) 6910" produced by Japan Coating Resin Corporation; and "Super Flex (trade name) 620" and "Super Flex (trade name) 650" produced by Dai-ichi Kogyo Seiyaku Co. Ltd.

In the cationic polymer containing the urethane structure described above, it is preferable that the urethane structure is obtained from aliphatic isocyanate and polyether-based polyol or polyester-based polyol.

The cationic inorganic fine particles are not specifically limited, which are exemplified, for example, by cationic silica, cationic alumina, cationic zirconia, and cationic ceria. Among them, cationic silica is preferred. The cationic silica may be coated with alumina.

The average particle diameter of the cationic inorganic fine particles is, for example, in a range of 5 nm to 80 nm, in a range of 10 nm to 50 nm, or in a range of 10 nm to 30 nm. The average particle diameter can be determined, for example, by means of the BET method. If the average particle diameter of the cationic inorganic fine particles is in a range of 10 nm to 30 nm, for example, it is possible to further suppress the color loss after the washing with water when an image is formed on fabric made of polyester.

The cationic inorganic fine particles may be so-called pearl necklace-shaped (rosary-shaped) cationic inorganic fine particles having such a shape that a plurality of particles are connected to one another. The average particle diameter of the pearl necklace-shaped cationic inorganic fine particles is, for example, in a range of 80 nm to 200 nm or in a range of 110 nm to 170 nm. The average particle diameter of the pearl necklace-shaped cationic inorganic fine particles can be determined, for example, by the dynamic light scattering method. The average particle diameter per single particle of the pearl necklace-shaped cationic inorganic fine particles is not specifically limited, which is, for example, in a range of 10 nm to 30 nm.

The cationic inorganic fine particles may be privately prepared in-house, or any commercially available product may be used therefor. The commercially available product is exemplified, for example, by "ST-AK" (alumina-coated cationic silica, average particle diameter: 10 nm to 15 nm (BET method)), "ST-AK-N" (alumina-coated cationic silica, average particle diameter: 10 nm to 15 nm (BET method)), "ST-AK-PS-S" (pearl necklace-shaped alumina-coated cationic silica, average particle diameter: 110 nm to 170 nm (dynamic light scattering method), average particle diameter per single particle: 10 nm to 30 nm), "AS-520" (cationic alumina, average particle diameter: 15 nm to 30 nm (BET method)), "ST-AK-L" (alumina-coated cationic silica, average particle diameter: 40 nm to 50 nm (BET method)), "ST-AK-YL" (alumina-coated cationic silica, average particle diameter: 50 nm to 80 nm (BET method)), "ST-AK-XS" (alumina-coated cationic silica, average particle diameter: 4 nm to 6 nm (BET method)), "ST-AK-A" (alumina-coated cationic silica, average particle diameter: 10 nm to 15 nm (BET method)), "AS-100" (cationic alumina, average particle diameter: 6 nm to 10 nm (BET method)), "AS-200" (cationic alumina, average particle diameter: 7 nm to 15 nm (BET method)), "AS-550" (cationic alumina, average particle diameter: 25 nm to 40 nm (BET method)), "ZR-30AL" (cationic zirconia, average particle diameter: 5 nm to 10 nm (BET method)), and "CE-20A" (cationic ceria, average particle diameter: 8 nm to 12 nm (BET method)) produced by Nissan Chemical Industries, Ltd.

The cationic surfactant described above is exemplified, for example, by quaternary ammonium salt, quaternary ammonium ion, primary, secondary, and tertiary amine salt type compounds, alkylamine salt, dialkylamine salt, aliphatic amine salt, alkylpyridinium salt, imidazolinium salt, sulfonium salt, phosphonium salt, and onium salt. Specified examples of the cationic surfactant other than the quaternary ammonium salt and the quaternary ammonium ion are exemplified, for example, by hydrochlorides and acetates of laurylamine, palm amine, rosin amine and the like, cetylpyridinium chloride, cetylpyridinium bromide, and dihydroxyethyllaurylamine. Among them, quaternary ammonium salt and quaternary ammonium ion are preferred.

The quaternary ammonium salt is exemplified, for example, by a cationic compound represented by the formula (A).

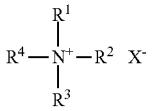

(A)

In the formula (A), $R^1$ to $R^4$ are hydrocarbon groups each having 1 to 20 carbon atoms respectively. $R^1$ to $R^4$ may be identical with each other or different from each other, and $X^-$ is an anion.

In the formula (A), $R^1$ to $R^3$ may be alkyl groups each having 1 to 5 carbon atoms respectively. The alkyl group having 1 to 5 carbon atoms may have a straight chain or a branched chain. It is possible to exemplify, for example, methyl group, ethyl group, n-propyl group, isopropyl group, n-butyl group, sec-butyl group, isobutyl group, tert-butyl group, n-pentyl group, isopentyl group, sec-pentyl group, 3-pentyl group, and tert-pentyl group. The alkyl group having 1 to 5 carbon atoms may have a substituent group such as halogen atom or the like. In the formula (A), $R^1$ to $R^3$ may be identical with each other or different from each other.

In the formula (A), $R^4$ may be an alkyl group having 6 to 30 carbon atoms. The alkyl group having 6 to 30 carbon atoms is exemplified, for example, by hexyl group, heptyl group, octyl group, nonyl group, decyl group, lauryl group (dodecyl group), tetradecyl group, and cetyl group (hexadecyl group). The alkyl group having 6 to 30 carbon atoms may have a substituent group such as halogen atom or the like, which may have either a straight chain or a branched chain.

In the formula (A), $X^-$ is an anion. The anion may be any anion. For example, it is possible to exemplify methylsulfate ion, ethylsulfate ion, sulfate ion, nitrate ion, acetate ion, dicarboxylate (for example, malate, itaconate and the like) ion, tricarboxylate (for example, citrate and the like) ion, hydroxide ion, and halide ion. When $X^-$ is dicarboxylate ion or tricarboxylate ion, dicarboxylate ion or tricarboxylate ion is the counter ion for two or three quaternary ammonium ions (cations obtained by removing $X^-$ from the formula (A)).

The cationic compound represented by the formula (A) is exemplified, for example, by lauryltrimethylammonium sulfate, lauryltrimethylammonium chloride, cetyltrimethylammonium chloride, and benzyldimethylalkylammonium chloride. The cationic compound represented by the formula (A) may be privately prepared in-house, or any commercially available product may be used therefor. The commercially available product is exemplified, for example, by "Catiogen (trade name) TML", "Catiogen (trade name) TMP", and "Catiogen (trade name) ES-O" produced by Dai-ichi Kogyo Seiyaku Co., Ltd. and "Benzalkonium chloride" produced by Tokyo Kasei Kogyo Co., Ltd.

The quaternary ammonium ion is exemplified, for example, by a cation obtained by removing $X^-$ from the formula (A).

The polyvalent metal salt is exemplified, for example, by aluminum chloride, aluminum bromide, aluminum sulfate, aluminum nitrate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogenphosphate, calcium thiocyanate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, manganese sulfate, manganese nitrate, manganese dihydrogenphosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate. Among them, polyvalent metal salts of calcium and magnesium are preferred. Further, divalent metal salts are preferred in view of the degree of coagulation of the colorant contained in the water-based ink described above.

The polyvalent metal ion is exemplified, for example, by aluminum ion, barium ion, calcium ion, copper ion, iron ion, magnesium ion, manganese ion, nickel ion, stannum ion, titanium ion, and zinc ion. Among them, calcium ion and magnesium ion are preferred. Further, divalent metal ion is preferred in view of the degree of coagulation of the colorant contained in the water-based ink described above.

One kind of the cationic substance as described above may be used singly, or two or more kinds of the cationic substances as described above may be used in combination. The blending amount of the cationic substance with respect to the entire amount of the treatment agent is, for example, in a range of 0.5% by weight to 20% by weight, in a range of 1% by weight to 20% by weight, or in a range of 1% by weight to 15% by weight. In particular, when the cationic substance is an emulsion of a cationic polymer containing the urethane structure, the blending amount of the cationic substance with respect to the entire amount of the treatment agent is preferably not less than 5% by weight and more preferably 5% by weight to 15% by weight.

The treatment agent may further contain water. The water contained in the treatment agent is preferably ion-exchange water or purified water (pure water). The blending amount of the water with respect to the entire amount of the treatment agent may be, for example, a balance of the other components.

The treatment agent may further contain a water-soluble organic solvent and an additive which are the same as or equivalent to those exemplified for the water-based ink described above.

It is preferable that the treatment agent contains substantially no colorant including, for example, dyes, pigments and the like in order that no influence is exerted on the coloration or colorfulness of the printed matter. The blending amount of the colorant with respect to the entire amount of the treatment agent is, for example, 0% by weight to 1% by weight or 0% by weight to 0.1% by weight.

The treatment agent can be prepared, for example, by uniformly or homogeneously mixing the cationic substance and optionally other additive components by means of any conventionally known method. The treatment agent may be, for example, in a liquid form (treatment solution) or in a gel form. When the treatment agent is in a liquid form (treatment solution) or in a gel form, it is easy to apply the treatment agent to the recording medium.

In the treatment agent applying step, the application of the treatment agent can be carried out, for example, by means of the spray system, the stamp application, the brush application, the roller application, the dipping (immersion in the treatment agent), and the ink-jet system. The application of the treatment agent may be carried out by using the treatment agent applying mechanism such as the spray mechanism or the like provided for the ink-jet recording apparatus of the present teaching, or the application of the treatment agent may be carried out at the outside of the ink-jet recording apparatus.

Figure 4:
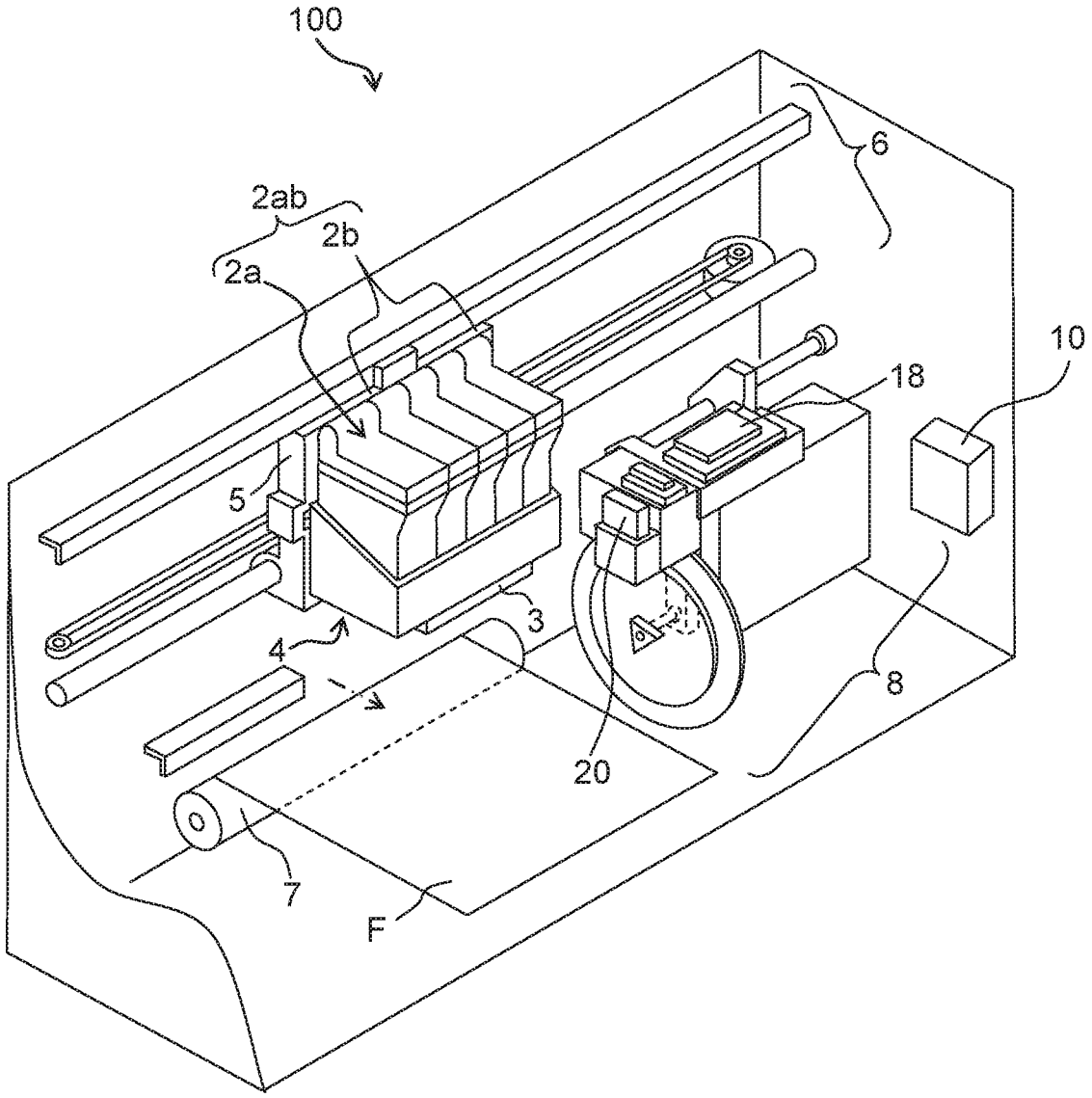
FIG. 4 shows a schematic perspective view illustrating another exemplary structure of an ink-jet recording apparatus of the present teaching.

When the application of the treatment agent is carried out by means of the ink-jet system, the image printing step and the treatment agent applying step may be carried out by using an ink-jet recording apparatus (an apparatus for forming an image) 100 shown in FIG. 4 in which an ink-jet head (ink discharge mechanism) 3 to be used in the image printing step also serve as the treatment agent applying mechanism. The ink-jet recording apparatus 100 has an ink cartridge assembly 2*ab* (ink set accommodating unit for accommodating an ink set including the water-based inks and the treatment agent) including a treatment agent cartridge 2*a* and four water-based ink cartridges 2*b*. The treatment agent cartridge 2*a* contains the treatment agent of the present teaching. Each of the four water-based ink cartridges 2*b* contains one color of the four color water-based inks of yellow, magenta, cyan, and black. In FIG. 4, the same portions as those of FIG. 1 are designated by the same reference numerals. The treatment agent contained in the treatment agent cartridge 2*a* can be applied to (discharged onto) the recording medium F (for example, fabric or the like) by means of the ink-jet head 3.

Figure 3A:
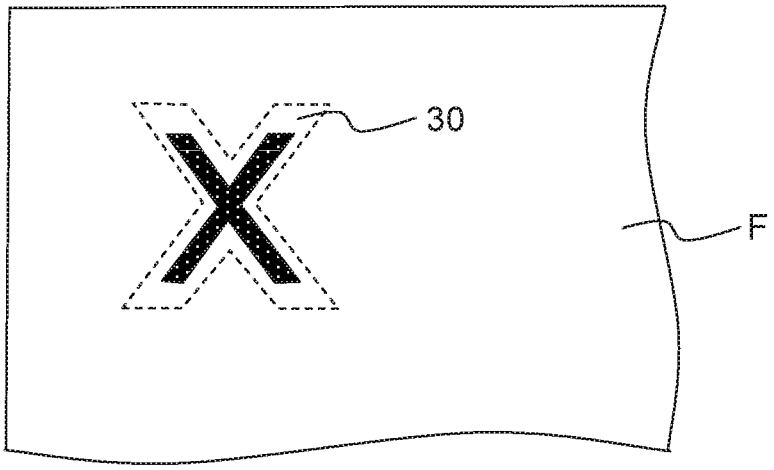
FIGS. 3A and 3B show examples of application of a treatment agent in an image forming method of the present teaching.
Figure 3B:
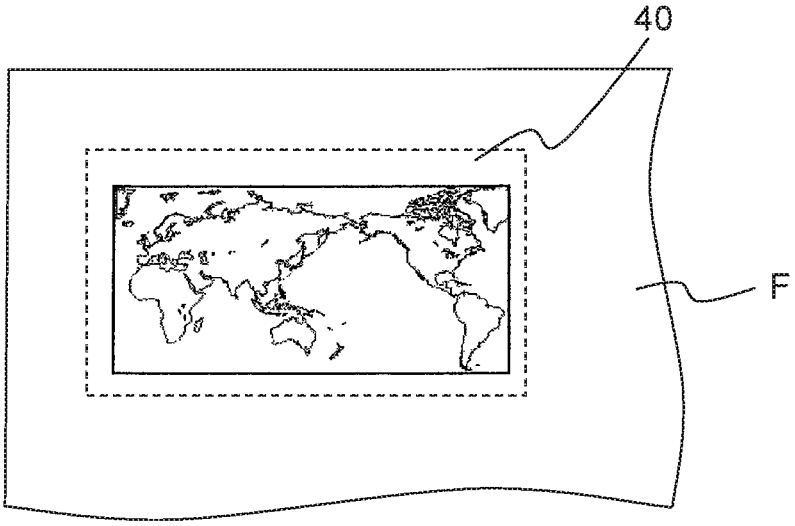

The treatment agent may be applied either to the entire surface or a part of the recording surface (image formation surface) of the recording medium. When the treatment agent is applied to a part of the recording surface, the application portion is at least the image printing portion subjected to the printing with the water-based ink on the recording surface (image formation surface) of the recording medium. When the treatment agent is applied to a part of the recording surface, it is preferable that the size of the application portion is larger than the image printing portion. For example, as shown in FIG. 3A, when an image of a letter (X) is printed on a recording medium F, it is preferable that the treatment agent is applied so that an application portion 30 is formed with a line width larger than a line width of the letter. Further, as shown in FIG. 3B, when an image of a pattern is printed on a recording medium F, it is preferable that the treatment agent is applied so that an application portion 40, which is larger than the pattern, is formed.

In the image forming method of the present teaching, the water-based ink is a water-based ink which causes coagulation or viscosity increase as a result of the contact with the treatment agent. Namely, the treatment agent coagulates the water-based ink or increases viscosity of the water-based ink. The coagulation or the viscosity increase may be caused, for example, such that the anionic colorant contained in the water-based ink is electrically attracted to the cationic substance contained in the treatment agent. When the recording medium is the fabric, then the water-based ink is brought in contact with the treatment agent to cause the coagulation or the viscosity increase on the fabric, and thus the water resistance of the printed matter is improved. Further, when the recording medium is the recording paper, if the treatment agent is applied to the recording paper, then the optical density (OD value) of the printed matter is improved.

When the water-based ink contains the anionic colorant, and the treatment agent contains the cationic substance, then the ratio (C/A) of the blending amount (C: % by weight) of the cationic compound in the entire amount of the treatment agent with respect to the blending amount (A: % by weight) of the anionic colorant in the entire amount of the water-based ink is, for example, 0.1 to 10 and preferably 0.2 to 5. If the ratio is within this range, the anionic colorant and the cationic compound interact more efficiently. Accordingly, when the recording medium is the fabric, the water resistance of the printed matter is improved. Further, when the recording medium is the recording paper, if the treatment agent is applied to the recording paper, then the optical density (OD value) of the printed matter is improved.

It is preferable that both of the water-based ink and the treatment agent contain an identical penetrant and/or an identical humectant. When the identical penetrant and/or the identical humectant is/are contained, then conformability is thereby improved between the water-based ink and the treatment agent on the recording medium. Accordingly, when the recording medium is the fabric, the water resistance of the printed matter is improved. Further, when the recording medium is the recording paper, if the treatment agent is applied to the recording paper, then the optical density (OD value) of the printed matter is improved. The penetrant is not specifically limited. For example, it is possible to use the penetrants mentioned above. Among them, it is preferable to use triethylene glycol n-butyl ether. The humectant is not specifically limited. For example, it is possible to use the humectants mentioned above. Among them, it is preferable to use glycerol.

In the image forming method of the present teaching, it is preferable that $T_P<T_F$ is given in the treatment agent applying step in relation to the application amount ($T_P$) of the treatment agent per unit area provided when the recording medium is the recording paper and the application amount ($T_F$) of the treatment agent per unit area provided when the recording medium is the fabric. The application amount of the treatment agent may be controlled by the control mechanism (controller 10) provided for the ink-jet recording apparatus of the present teaching. If the application amount ($T_P$) of the treatment agent per unit area of the recording paper is excessively large, it is feared that the printed matter may be curled. If the application amount ($T_F$) of the treatment agent per unit area of the fabric is excessively small, it is feared that the water resistance of the printed matter may not be improved sufficiently. If the application amount ($T_F$) of the treatment agent per unit area of the fabric is larger than the application amount ($T_P$) of the treatment agent per unit area of the recording paper ($T_P<T_F$), then the curl of the printed matter of the recording paper can be thereby suppressed, and the water resistance of the printed matter of the fabric can be thereby improved.

In the image forming method of the present teaching, it is preferable that $T_P$ is 0 mg/cm$^2$ (0 mg/inch$^2$) to 1.1 mg/cm$^2$ (7.1 mg/inch$^2$), and $T_F$ is 5.0 mg/cm$^2$ (32 mg/inch$^2$) to 48 mg/cm$^2$ (310 mg/inch$^2$) in the treatment agent applying step. Further, it is more preferable that $T_P$ is 0 mg/cm$^2$ to 0.6 mg/cm$^2$, and $T_F$ is 18 mg/cm$^2$ to 48 mg/cm$^2$. If $T_P$ is within the foregoing range, it is thereby possible to sufficiently suppress the curl of the printed matter of the recording paper. If $T_F$ is within the foregoing range, it is thereby possible to sufficiently improve the water resistance of the printed matter of the fabric.

Further, the preferred range of $T_P$ of 0 mg/cm$^2$ to 1.1 mg/cm$^2$ and the more preferred range of 0 mg/cm$^2$ to 0.6 mg/cm$^2$ include $T_P$=0 mg/cm$^2$. $T_P$=0 mg/cm$^2$ resides in such a mode that the treatment agent is not applied to the recording medium. Even in the case of the mode in which the treatment agent is not applied to the recording medium ($T_P$=0 mg/cm$^2$), an effect is obtained such that the curl of the printed matter is sufficiently suppressed. On the other hand, If the recording medium is the recording paper, it is preferable to apply the treatment agent to the recording paper in view of the improvement of the optical density (OD value) of the printed matter. In view of the improvement of the optical density (OD value) of the printed matter, it is preferable that $T_P$ is, for example, not less than 0.3 mg/cm$^2$ or 0.3 mg/cm$^2$ to 1.1 mg/cm$^2$.

In the image forming method of the present teaching, when the recording medium is the recording paper, it is preferable that the discharge amount ($I_P$) per unit area of the water-based ink and the application amount ($T_P$) per unit area of the treatment agent are set in the image printing step and the treatment agent applying step so that $T_P/I_P$=0 to 0.92 and $T_P+I_P<2.3$ mg/cm$^2$ (15 mg/inch$^2$) are fulfilled. Further, when the recording medium is the fabric, it is preferable that the discharge amount ($I_F$) per unit area of the water-based ink and the application amount ($T_F$) per unit area of the treatment agent are set in the image printing step and the treatment agent applying step so that $T_F/I_F>3.1$ is fulfilled. If the recording medium is the recording paper, it is more preferable that $T_P/I_P$=0 to 0.86 and ($T_P+I_P$)=0.7 mg/cm$^2$ to 1.3 mg/cm$^2$ are fulfilled. If the recording medium is the fabric, it is more preferable that $T_F/I_F$=26 to 48 is fulfilled. If ($T_P/I_P$) and ($T_P+I_P$) are within the foregoing ranges, it is thereby possible to sufficiently suppress the curl of the printed matter of the recording paper. If ($T_F/I_F$) is within the foregoing range, it is thereby possible to sufficiently improve the water resistance of the printed matter of the fabric.

The image forming method of the present teaching may further include a drying step of drying the treatment agent applied in the treatment agent applying step when the recording medium is the fabric. The drying step may be carried out, for example, before the image printing step, or the drying step may be carried out after the image printing step. When the drying step is carried out before the image printing step, then the blurring of the water-based ink can be suppressed by drying the treatment agent before discharging the water-based ink. On this account, when the drying step is carried out before the image printing step, a larger amount of the treatment agent can be applied to the fabric, as compared with when the drying step is carried out after the image printing step. For example, when the drying step is carried out before the image printing step, it is preferable that $T_F$ is 5.0 mg/cm$^2$ (32 mg/inch$^2$) to 48 mg/cm$^2$ (310 mg/inch$^2$) in the treatment agent applying step. When the drying step is carried out after the image printing step, it is preferable that $T_F$ is 5.0 mg/cm$^2$ (32 mg/inch$^2$) to 34 mg/cm$^2$ (220 mg/inch$^2$) in the treatment agent applying step. Note that in the image forming method of the present teaching, the execution of the drying step is arbitrary. It is also allowable that the drying step is not carried out when the recording medium is the fabric.

The drying may be, for example, air drying (natural drying). Alternatively, the drying may be performed by using any commercially available drying mechanism such as an iron, a hot press machine, a dryer, an oven, a belt conveyer oven and the like. The drying temperature is, for example, 100° C. to 250° C., and the drying time is, for example, 30 seconds to 120 seconds. The drying temperature may be, for example, either a temperature of the drying atmosphere or a setting temperature of the drying mechanism.

Figure 2:
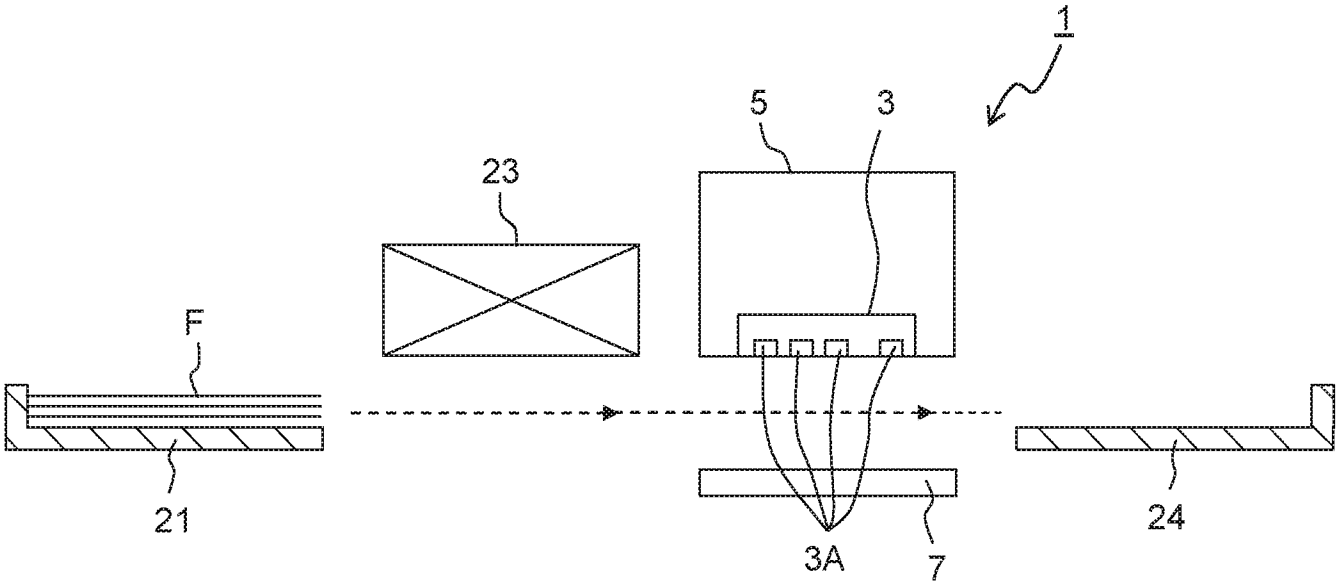
FIG. 2 schematically shows the structure of the ink-jet recording apparatus of the present teaching.

As shown in FIG. 2, the drying step may be carried out, for example, by using the drying mechanism 23 provided for the ink-jet recording apparatus 1 of the present teaching shown in FIG. 1. The same portions of FIG. 2 as those of FIG. 1 are designated by the same reference numerals. Note that in FIG. 2, the reference numeral 21 and the reference numeral 24 indicate the supply tray and the discharge tray which are omitted from the illustration in FIG. 1, and the reference numeral 3A indicates a plurality of nozzles formed on the lower surface of the ink-jet head 3. Further, the drying step may be carried out at the outside of the ink-jet recording apparatus.

In the drying step, for example, the weight of the applied treatment agent may be decreased to be not more than 50% of the application amount of the treatment agent upon the application, or the weight may be decreased to be not more than 30%. The drying step can be also referred to as a solvent volatilization step of volatilizing the solvent (for example, the water and the water-soluble organic solvent) contained in the treatment agent, or a weight decreasing step of decreasing the weight of the treatment agent.

The image forming method of the present teaching includes a washing step of washing the fabric with water when the recording medium is the fabric. The treatment agent applying step, the drying step, the image printing step, and the washing step may be carried out in this order. As described above, when the recording medium is the fabric, for example, the colorant contained in the water-based ink is brought in contact with the cationic compound contained in the treatment agent to cause the coagulation or the viscosity increase on the fabric. Thus, the water resistance of the printed matter is improved. On the other hand, if the colorant, which does not cause the coagulation or the like, exists on the fabric, the colorant in such a state is eluted into water with ease. Therefore, the printed matter has no sufficient water resistance. In view of the above, the washing step is provided after the image printing step, and the colorant, which does not cause the coagulation or the like, is washed out from the fabric. Thus, it is possible to enhance the water resistance of the printed matter.

As explained above, the image forming method of the present teaching makes it possible to improve the fastness against water of the printed matter formed on the fabric, and the image forming method of the present teaching also makes it possible to form the image on the recording paper.

[Example of Image Forming Method]

Figure 5:
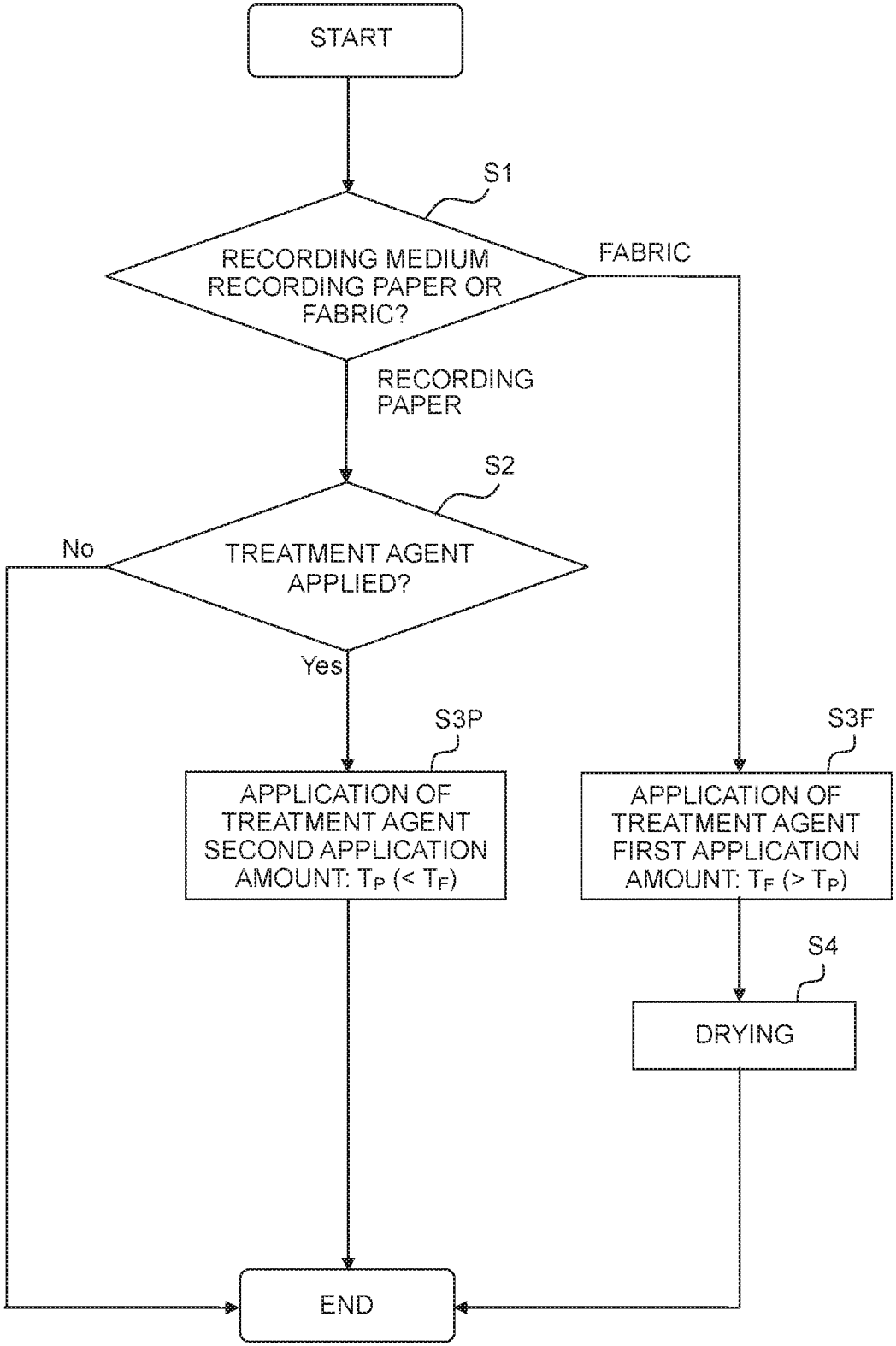
FIG. 5 shows a flow chart illustrating the preparation of the recording medium in an exemplary image forming method of the present teaching.
Figure 6:
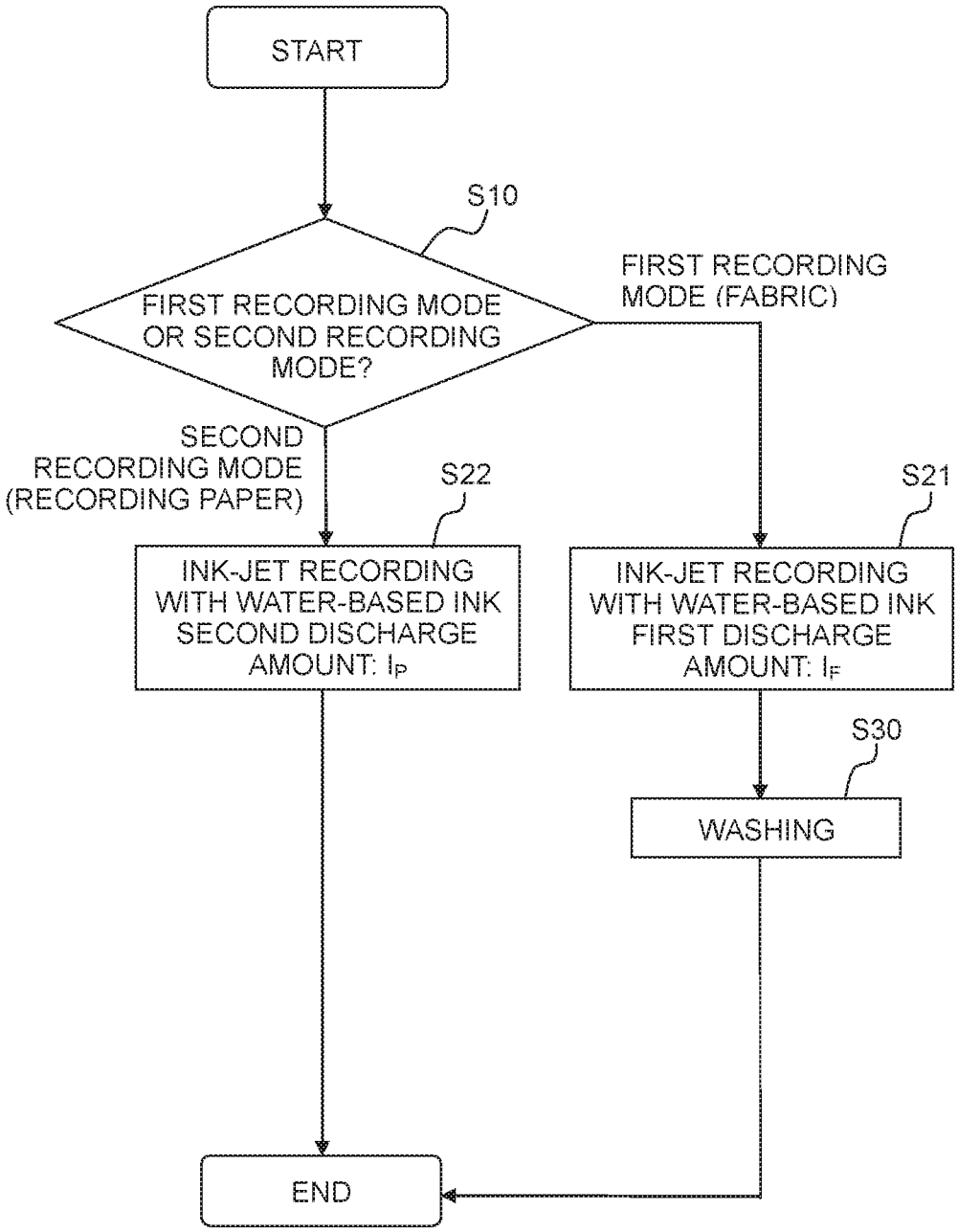
FIG. 6 shows a flow chart illustrating an exemplary image forming method of the present teaching.

An example of the image forming method of the present teaching will be further explained in accordance with flow charts shown in FIGS. 5 and 6. Note that the image forming method explained below is referred to by way of example, and the present teaching is not limited thereto.

The present teaching resides in an image forming method for forming an image on a recording medium, including:

preparing the recording medium which is fabric or recording paper; and determining whether a first recording mode or a second recording mode is executed;

in the first recording mode, discharging a first discharge amount ($I_F$) of a water-based ink per unit area onto the fabric by an ink-jet system; and in the second recording mode, discharging a second discharge amount ($I_P$) of the water-based ink per unit area onto the recording paper by the ink-jet system, the water-based ink being identical to the water-based ink in the first recording mode.

The preparation of the recording medium includes:

selecting the fabric or the recording paper;

when the fabric is selected, applying a first application amount ($T_F$) of a treatment agent per unit area to the fabric, the treatment agent coagulating the water-based ink or increasing viscosity of the water-based ink;

when the recording paper is selected, selecting whether or not the treatment agent is applied to the recording paper; and when the application of the treatment agent to the recording paper is selected, applying a second application amount ($T_P$) of the treatment agent per unit area to the recording paper, the second application amount ($T_P$) being smaller than the first application amount ($T_F$).

The image forming method of the present teaching includes the preparation of the recording medium which is the fabric or the recording paper. The preparation of the recording medium will be explained in accordance with the flow chart shown in FIG. 5. As shown in FIG. 5, at first, the fabric or the recording paper is selected as the recording medium (Step S1 shown in FIG. 5). When the fabric is selected in Step S1 shown in FIG. 5, the treatment agent is applied to the fabric so that the application amount per unit area is the first application amount ($T_F$) (Step S3F shown in FIG. 5). Accordingly, the recording medium (hereinafter referred to as "first recording medium" in some cases, if necessary), in which the first application amount ($T_F$) has been applied per unit area to the fabric, is prepared.

If the recording paper is selected in Step S1 shown in FIG. 5, it is further selected whether or not the treatment agent is applied to the recording paper (Step S2 shown in FIG. 5). For example, if it is intended to obtain the printed matter having a high optical density, it is also allowable to select the application of the treatment agent to the recording paper. Further, for example, if it is intended to suppress the curl of the printed matter, it is also allowable to select that the treatment agent is not applied to the recording paper. If it is selected to apply the treatment agent to the recording paper, the treatment agent is applied to the recording paper so that the application amount per unit area is the second application amount ($T_P$) which is smaller than the first application amount ($T_F$) (Step S3P shown in FIG. 5). Accordingly, the recording medium (hereinafter referred to as "second recording medium" in some cases, if necessary), in which the second application amount ($T_P$) is applied per unit area to the recording paper, is prepared. If it is selected that the treatment agent is not applied to the recording paper in Step S2 shown in FIG. 5, the recording paper (hereinafter referred to as "third recording medium" in some cases, if necessary), which is not subjected to the treatment with the treatment agent, is prepared as the recording medium.

If the fabric is selected in Step S1 shown in FIG. 5, the preparation of the recording medium may further include drying the treatment agent applied to the fabric (Step S4 shown in FIG. 5).

The preparation of the recording medium explained above may be performed by a user. For example, the user may perform the selection of the fabric or the recording paper (Step S1 shown in FIG. 5) and the selection of whether or not the treatment agent is applied to the recording paper (Step S2 shown in FIG. 5). Further, the user may apply the treatment agent to the recording medium by means of, for example, the spray system (Steps S3P, S3F shown in FIG. 5). The treatment agent applied to the fabric may be dried by means of, for example, an iron or a dryer (Step S4 shown in FIG. 5).

Next, an explanation will be made in accordance with a flow chart shown in FIG. 6 about an image forming method for forming an image on the prepared recording medium. At first, it is determined whether the first recording mode or the second recording mode is executed (Step S10 shown in FIG. 6). The recording mode is determined, for example, as follows. In this exemplary embodiment, the first recording mode is a recording mode in which the recording medium is fabric, and the second recording mode is a recording mode in which the recording medium is recording paper. A user performs the operation, for example, on a user interface such as a panel or the like provided for the ink-jet recording apparatus 1 shown in FIG. 1. If an image is formed on the first recording medium which is the fabric. "printing on fabric (first recording mode)" is selected. If an image is formed on the second or third recording medium which is the recording paper, "printing on recording paper (second recording mode)" is selected. The controller 10 may determine whether the first recording mode or the second recording mode is executed in accordance with a signal inputted from the user interface. Alternatively, the controller 10 may determine whether the first recording mode or the second recording mode is executed in accordance with a flag corresponding to the mode selected on the user interface. Specifically, for example, if the first recording mode is selected by the user, the flag is stored in a storage area such as RAM or the like of the controller 10. It is also allowable that the controller 10 determines the execution of the first mode if the flag is stored.

In the first recording mode, the recording medium is the first recording medium which is the fabric. The water-based ink is discharged onto the fabric in accordance with the ink-jet system so that the discharge amount per unit area is the first discharge amount ($I_F$) (Step S21 shown in FIG. 6). In the second recording mode, the recording medium is the second or third recording medium which is the recording paper. In the image forming method, the water-based ink is discharged onto the recording paper in accordance with the ink-jet system so that the discharge amount per unit area is the second discharge amount ($I_P$) (Step S22 shown in FIG. 6).

In the first recording mode, it is preferable that the first discharge amount ($I_F$) fulfills $T_F/I_F>3.1$ in relation to the first application amount ($T_F$). In the second recording mode, it is preferable that the second discharge amount ($I_P$) fulfills $T_P/I_P=0$ to 0.92 and $T_P+I_P<2.3$ mg/cm$^2$ in relation to the second application amount ($T_P$). The identical water-based ink is used for the first mode and the second mode.

In the first recording mode, the image forming method may further include washing the fabric with water after discharging the water-based ink onto the fabric (Step S30 shown in FIG. 6).

EXAMPLES

Next, Examples of the present teaching will be explained together with Comparative Examples. Note that the present teaching is not limited to and restricted by Examples and Comparative Examples described below.

[Preparation of Treatment Agent]

Respective components of treatment agent compositions (Table 1) were mixed uniformly or homogeneously to obtain nine types of treatment agents 1 to 8 and c1.

TABLE 1

| | | | 1 | 2 | 3 | 4 | 5 |
|---|---|---|---|---|---|---|---|
| Treatment agent composition (% by weight) | Cationic substance | Urethane acrylic emulsion A (*1) | 10 | 1.5 | 15 | — | — |
| | | Urethane acrylic emulsion B (*2) | — | — | — | 10 | — |
| | | Urethane acrylic emulsion C (*3) | — | — | — | — | 5 |
| | | Urethane acrylic emulsion D (*4) | — | — | — | — | — |
| | | Cationic inorganic fine particles (*11) | — | — | — | — | — |
| | | Quaternary ammonium salt (*5) | — | — | — | — | — |
| | Anionic substance | Urethane acrylic emulsion E (*6) | — | — | — | — | — |
| | Humectant | Glycerol | 10 | 10 | 10 | 10 | 5 |
| | Penetrant | Triethylene glycol n-butyl ether | 0.5 | 0.5 | 0.5 | 0.5 | 0.5 |
| | Surfactant | Olfine (trade name) E1010 (*7) | 0.2 | 0.2 | 0.2 | 0.2 | 0.2 |
| | | Water | balance | balance | balance | balance | balance |

| | | | 6 | 7 | 8 | c1 |
|---|---|---|---|---|---|---|
| Treatment agent | Cationic substance | Urethane acrylic emulsion A (*1) | — | — | — | — |
| | | Urethane acrylic emulsion B (*2) | — | — | — | — |

TABLE 1-continued

| | | | | | | |
|---|---|---|---|---|---|---|
| composition (% by weight) | | Urethane acrylic emulsion C (*3) | — | — | — | — |
| | | Urethane acrylic emulsion D (*4) | 10 | — | — | — |
| | | Cationic inorganic fine particles (*11) | — | 10 | — | — |
| | | Quaternary ammonium salt (*5) | — | — | 10 | — |
| | Anionic substance | Urethane acrylic emulsion E (*6) | — | — | — | 10 |
| | Humectant | Glycerol | 10 | 10 | 10 | 10 |
| | Penetrant | Triethylene glycol n-butyl ether | 0.5 | 0.5 | 0.5 | 0.5 |
| | Surfactant | Olfine (trade name) E1010 (*7) | 0.2 | 0.2 | 0.2 | 0.2 |
| | | Water | balance | balance | balance | balance |

Table 1 - LEGEND (*1) Weight average molecular weight 20000; ratio of occupation of urethane structure in solid content 60% by weight; numerical values in Table indicate solid content amounts (*2) Weight average molecular weight 3000; ratio of occupation of urethane structure in solid content 60% by weight; numerical value in Table indicates solid content amount (*3) Weight average molecular weight 500000; ratio of occupation of urethane structure in solid content 60% by weight; numerical value in Table indicates solid content amount (*4) Weight average molecular weight 20000; ratio of occupation of urethane structure in solid content 10% by weight; numerical value in Table indicates solid content amount (*5) Lauryl trimethylammonium sulfate (*6) Weight average molecular weight 20000; ratio of occupation of urethane structure in solid content 60% by weight; numerical value in Table indicates solid content amount (*7) Produced by Nissin Chemical Industry Co., Ltd.; numerical values in Table indicate active ingredient amounts (*11) ST-AK-PS-S (trade name) produced by Nissan Chemical Industries, Ltd.; pearl necklace-shaped alumina-coated cationic silica; numerical value in Table indicates solid content amount

[Preparation of Water-Based Pigment Inks Bk and M]

Components, from which CAB-O-JET (trade name) 200 or a pigment dispersion liquid of each of water-based ink compositions (Table 2) was excluded, were mixed uniformly or homogeneously to obtain ink solvents. Subsequently, the ink solvent was added to CAB-O-JET (trade name) 200 dispersed in water or the pigment dispersion liquid, followed by being mixed homogeneously. After that, obtained mixtures were filtrated through a cellulose acetate type membrane filter (pore size: 3.00 μm) produced by Toyo Roshi Kaisha, Ltd., and thus water-based pigment inks for ink-jet recording Bk and M shown in Table 2 were obtained.

[Preparation of Water-Based Dye Inks Y, C1, and C1c]

Respective components of water-based ink compositions (Table 2) were mixed uniformly or homogeneously. After that, obtained mixtures were filtrated through a polytetrafluoroethylene (PTFE) type membrane filter (pore size: 0.20 μm) produced by Toyo Roshi Kaisha, Ltd., and thus water-based dye inks for ink-jet recording Y, C1, and C1c shown in Table 2 were obtained.

TABLE 2

| | | | Bk | M | Y | C1 | C1c |
|---|---|---|---|---|---|---|---|
| Water-based ink composition | Anionic colorant | CAB-O-JET (trade name) 200 (*8) | 4 | — | — | — | — |
| | | Pigment dispersion liquid (*9) | — | 4 | — | — | — |
| | | C.I. Direct Yellow 86 | — | — | 4 | — | — |
| | | C.I. Acid Blue 90 | — | — | — | 4 | — |
| | Cationic colorant | C.I. Basic Blue 17 | — | — | — | — | 4 |
| | Humectant | Glycerol | 20 | 20 | 20 | 20 | 20 |
| | Penetrant | Triethylene glycol n-butyl ether | 2 | 2 | 2 | 2 | 2 |
| | Surfactant | Sunnol (trade name) NL 1430 (*10) | 0.2 | 0.2 | 0.2 | 0.2 | 0.5 |
| | | Water | balance | balance | balance | balance | balance |

Table 2 - LEGEND (*8) Self-dispersible pigment; produced by Cabot Corporation; numerical value in Table indicates pigment solid content amount (*9) Aqueous dispersion of C.I. Pigment Red 122 (containing resin dispersing agent); numerical value in Table indicates pigment solid content amount (*10) Produced by Lion Specialty Chemicals Co., Ltd.; numerical values in Table indicate pigment solid content amounts Unit of water-based ink composition is % by weight.

Example 1

The treatment agent 1 shown in Table 1 was uniformly applied by the spray method to a recording surface (image formation surface) of cotton (sheeting) having a planar size of 15 cm×5 cm. In this procedure, the application amount ($T_F$) of the treatment agent 1 per unit area was 18 mg/cm$^2$. Subsequently, the applied treatment agent was dried under a condition of 200° C. for 120 seconds by using an iron. Subsequently, an image was printed on the recording surface (image formation surface) of the cotton with the water-based dye ink Y shown in Table 2 by using a digital multifunction machine equipped with an ink-jet printer DCP-J4225N produced by Brother Industries, Ltd. In this procedure, the discharge amount ($I_F$) of the water-based dye ink Y per unit area was 0.7 mg/cm$^2$. In this way, an evaluation sample was prepared.

Example 2

An evaluation sample was prepared in the same manner as in Example 1 except that polyester twill having the same planar size was used in place of the cotton.

Examples 3 to 5

Evaluation samples were prepared in the same manner as in Example 1 except that the application amount ($T_F$) of the treatment agent 1 per unit area and the discharge amount ($I_F$) of the water-based dye ink Y per unit area were changed as shown in Table 3.

Examples 6 to 11

Evaluation samples were prepared in the same manner as in Example 1 except that the treatment agents 2 to 7 shown in Table 1 were used in place of the treatment agent 1.

Example 12

An evaluation sample was prepared in the same manner as in Example 11 except that polyester twill having the same planar size was used in place of the cotton.

Example 13

An evaluation sample was prepared in the same manner as in Example 1 except that the treatment agent 8 shown in Table 1 was used in place of the treatment agent 1.

Examples 14 to 16

Evaluation samples were prepared in the same manner as in Example 1 except that the water-based pigment ink Bk, the water-based pigment ink M, or the water-based dye ink C1 was used in place of the water-based dye ink Y.

Comparative Example 1

An evaluation sample was prepared in the same manner as in Example 1 except that the treatment agent c1 shown in Table 1 was used in place of the treatment agent 1.

Comparative Example 2

An evaluation sample was prepared in the same manner as in Comparative Example 1 except that polyester twill having the same planar size was used in place of the cotton.

Comparative Example 3

An evaluation sample was prepared in the same manner as in Example 1 except that the water-based dye ink C1c was used in place of the water-based dye ink Y.

Comparative Example 4

An evaluation sample was prepared in the same manner as in Example 1 except that the application of the treatment agent was not performed.

Evaluation of the water resistance was carried out by means of the following method for Examples 1 to 16 and Comparative Examples 1 to 4.

<Method for Evaluating Water Resistance>

The evaluation sample was washed with water for 5 minutes while shaking the evaluation sample to such an extent that a part of the evaluation sample was not rubbed with other parts in water. The optical density (OD value) of the evaluation sample obtained by being dried after the washing with water was measured by using a spectrophotometer Spectro Eye produced by X-Rite (light source: $D_{50}$, field angle: 2°, ANSI-T) to calculate the difference (ΔOD=OD value before washing with water−OD value after washing with water) in the optical density (OD value) before and after the washing with water. It is possible to judge that the smaller ΔOD is, the more excellent the water resistance is.

The types of the treatment agents and the water-based inks used in Examples 1 to 16 and Comparative Examples 1 to 4, the application amount ($T_F$) of the treatment agent, the discharge amount ($I_F$) of the water-based ink, $T_F/I_F$, and the evaluation results are shown in Tables 3 and 4.

TABLE 3

| | Example | | | | | | | |
|---|---|---|---|---|---|---|---|---|
| | 1 | 2 | 3 | 4 | 5 | 6 | 7 | 8 |
| Treatment agent | 1 | 1 | 1 | 1 | 1 | 2 | 3 | 4 |
| Water-based ink | Y | Y | Y | Y | Y | Y | Y | Y |
| Application amount ($T_F$) of treatment agent (mg/cm$^2$) | 18 | 18 | 48 | 5 | 5 | 18 | 18 | 18 |
| Discharge amount ($I_F$) of water-based ink (mg/cm$^2$) | 0.7 | 0.7 | 1 | 0.3 | 1.6 | 0.7 | 0.7 | 0.7 |
| $T_F/I_F$ | 26 | 26 | 48 | 17 | 3.1 | 26 | 26 | 26 |
| Water resistance (ΔOD before and after washing of cotton) | 0.02 | — | 0.01 | 0.07 | 0.09 | 0.08 | 0.01 | 0.03 |
| Water resistance (ΔOD before and after washing of polyester) | — | 0.05 | — | — | — | — | — | — |

| | Example | | | | | | | |
|---|---|---|---|---|---|---|---|---|
| | 9 | 10 | 11 | 12 | 13 | 14 | 15 | 16 |
| Treatment agent | 5 | 6 | 7 | 7 | 8 | 1 | 1 | 1 |
| Water-based ink | Y | Y | Y | Y | Y | Bk | M | C1 |
| Application amount ($T_F$) of treatment agent (mg/cm$^2$) | 18 | 18 | 18 | 18 | 18 | 18 | 18 | 18 |
| Discharge amount ($I_F$) of water-based ink (mg/cm$^2$) | 0.7 | 0.7 | 0.7 | 0.7 | 0.7 | 0.7 | 0.7 | 0.7 |
| $T_F/I_F$ | 26 | 26 | 26 | 26 | 26 | 26 | 26 | 26 |
| Water resistance (ΔOD before and after washing of cotton) | 0.02 | 0.03 | 0.03 | — | 0.08 | 0.02 | 0.02 | 0.01 |
| Water resistance (ΔOD before and after washing of polyester) | — | — | — | 0.04 | — | — | — | — |

TABLE 4

| | Comparative Example | | | |
|---|---|---|---|---|
| | 1 | 2 | 3 | 4 |
| Treatment agent | c1 | c1 | 1 | — |
| Water-based ink | Y | Y | C1c | Y |
| Application amount ($T_F$) of treatment agent (mg/cm$^2$) | 18 | 18 | 18 | 0 |
| Discharge amount ($I_F$) of water-based ink (mg/cm$^2$) | 0.7 | 0.7 | 0.7 | 0.7 |
| $T_F/I_F$ | 26 | 26 | 26 | 0 |
| Water resistance (ΔOD before and after washing of cotton) | 0.34 | — | 0.45 | 0.38 |
| Water resistance (ΔOD before and after washing of polyester) | — | 0.40 | — | — |

As shown in Table 3, the evaluation results of the water resistance were satisfactory in Examples 1 to 16.

In Examples 1 and 3 in which the application amount ($T_F$) of the treatment agent was 18 mg/cm$^2$ or 48 mg/cm$^2$ and $T_F/I_F$ was 26 or 48, the evaluation results of the water resistance were more excellent as compared with Examples 4 and 5 which were in the same condition except that the application amount ($T_F$) of the treatment agent was 5 mg/cm$^2$ and $T_F/I_F$ was 17 or 3.1.

In Examples 1 and 7 in which the blending amount of the cationic substance was not less than 10%/o by weight, the evaluation results of the water resistance were more excellent as compared with Example 6 which was in the same condition except that the blending amount of the cationic substance was 1.5% by weight.

In Examples 1, 8, 10, and 11 in which the urethane acrylic emulsion or the cationic inorganic fine particles was/were used as the cationic substance, the evaluation results of the water resistance were more excellent as compared with Example 13 which was in the same condition except that the quaternary ammonium salts was used as the cationic substance.

On the other hand, as shown in Table 4, in Comparative Examples 1 and 2 in which the anionic substance was used in place of the cationic substance, the evaluation results of the water resistance were unsatisfactory. Further, the evaluation result of the water resistance was also unsatisfactory in Comparative Example 3 in which the coagulation or the viscosity increase was not caused even when the water-based ink was brought in contact with the treatment agent, owing to the use of the cationic colorant as the colorant of the water-based ink. Further, the evaluation result of the water resistance was also unsatisfactory in Comparative Example 4 in which the treatment agent was not used.

Example 17

The digital multifunction machine equipped with the ink-jet printer DCP-J4225N was used to perform the printing on a recording surface (image formation surface) of recording paper ("Super White+" produced by ASKUL), and an image was printed on the recording surface (image formation surface) of the recording paper with the water-based pigment ink Bk shown in Table 2. In this procedure, the discharge amount ($I_P$) of the water-based pigment ink Bk per unit area was 0.7 mg/cm$^2$. In this way, an evaluation sample was prepared.

Example 18

The treatment agent 1 shown in Table 1 was applied uniformly by means of the spray system to the recording surface (image formation surface) of the recording paper. In this procedure, the application amount ($T_P$) per unit area of the treatment agent 1 was 0.3 mg/cm$^2$. Subsequently, the applied treatment agent was dried by means of the air drying (natural drying) for 10 minutes. Subsequently, the digital multifunction machine equipped with the ink-jet printer DCP-J4225N was used to print an image on the recording surface (image formation surface) of the recording paper by using the water-based pigment ink Bk shown in Table 2. In this procedure, the discharge amount ($I_P$) per unit area of the water-based pigment ink Bk was 0.7 mg/cm$^2$. In this way, an evaluation sample was prepared.

Example 19

An evaluation sample was prepared in the same manner as in Example 18 except that the application amount ($T_P$) of the treatment agent 1 per unit area was changed as shown in Table 5.

Example 20

An evaluation sample was prepared in the same manner as in Example 18 except that the application amount ($T_P$) of the treatment agent 1 per unit area and the discharge amount ($I_P$) of the water-based pigment ink Bk per unit area were changed as shown in Table 5.

Example 21

An evaluation sample was prepared in the same manner as in Example 17 except that the water-based dye ink C1 shown in Table 2 was used in place of the water-based pigment ink Bk.

Example 22

An evaluation sample was prepared in the same manner as in Example 18 except that the water-based dye ink C1 shown in Table 2 was used in place of the water-based pigment ink Bk.

In relation to Examples 17 to 22, (a) the measurement of the optical density (OD value) and (b) the curl evaluation were carried out in accordance with the following methods.

(a) Measurement of Optical Density (OD Value)

The optical density of the evaluation sample was measured by using the spectrophotometer Spectro Eye (light source: $D_{50}$, field angle: 2°, ANSI-T).

(b) Curl Evaluation

In relation to Examples 18 to 20 and 22, the curl (degree of warpage) of the recording paper (A4 size (210 mm×297 mm)) applied with the treatment agent after the air drying was observed by means of the visual observation. In relation to Examples 17 and 21, the curl of the recording paper was observed by means of the visual observation. The evaluation was made in accordance with the following evaluation criteria.

<Curl Evaluation, Evaluation Criteria>

AA: Curl (warpage) of recording paper was scarcely observed.

A: Curl (warpage) was slightly observed at end portion of recording paper.

Table 5 shows the types of the treatment agent and the water-based ink used in Examples 17 to 20, the application amount ($T_P$) of the treatment agent, the discharge amount ($I_P$) of the water-based ink, $T_P/I_P$, $T_P+I_P$ and the evaluation results.

TABLE 5

| | Example | | | | | |
|---|---|---|---|---|---|---|
| | 17 | 18 | 19 | 20 | 21 | 22 |
| Treatment agent | — | 1 | 1 | 1 | — | 1 |
| Water-based ink | Bk | Bk | Bk | Bk | C1 | C1 |
| Application amount ($T_P$) of treatment agent (mg/cm$^2$) | — | 0.3 | 0.6 | 1.1 | — | 0.3 |
| Discharge amount ($I_P$) of water-based ink (mg/cm$^2$) | 0.7 | 0.7 | 0.7 | 1.2 | 0.7 | 0.7 |

TABLE 5-continued

| | Example | | | | | |
|---|---|---|---|---|---|---|
| | 17 | 18 | 19 | 20 | 21 | 22 |
| $T_P/I_P$ | 0 | 0.43 | 0.86 | 0.92 | 0 | 0.43 |
| $T_P + I_P$ | 0.7 | 1.0 | 1.3 | 2.3 | 0.7 | 1.0 |
| Optical density (OD value) | 1.01 | 1.11 | 1.12 | 1.16 | 0.91 | 1.00 |
| Curl | AA | AA | AA | A | AA | AA |

As shown in Table 5, the optical density (OD value) was high and the evaluation result of the curl was satisfactory in Examples 17 to 22. The optical density (OD value) was higher in Examples 18 and 19 in which the treatment agent was applied as compared with Example 17 which was in the same condition except that the treatment agent was not applied. Similarly, the optical density (OD value) was higher in Example 22 in which the treatment agent was applied as compared with Example 21 which was in the same condition except that the treatment agent was not applied. Further, the evaluation result of the curl was more excellent in Examples 17 to 19, 21 and 22 in which the application amount of the treatment agent was not more than 0.6 mg/cm$^2$ as compared with Example 20 in which the application amount of the treatment agent was 1.1 mg/cm$^2$.

Parts or all of the embodiments and Examples described above can be also described as follows. However, the present teaching is not limited to the following description.

An image forming method for forming an image on a recording medium including fabric and recording paper by using a water-based ink may include:

an image printing step of printing the image by discharging the water-based ink onto the recording medium by an ink-jet system, wherein:

an identical chromatic color ink included in the water-based ink is used in the image printing step irrelevant to a type of the recording medium; and the method further includes a treatment agent applying step of applying a treatment agent to the fabric if the recording medium is the fabric.

The water-based ink may cause coagulation or viscosity increase upon contact with the treatment agent.

In the treatment agent applying step, an application amount ($T_P$) of the treatment agent per unit area provided if the recording medium is the recording paper and an application amount ($T_F$) of the treatment agent per unit area provided if the recording medium is the fabric may be set so that $T_P<T_F$ is fulfilled.

$T_P$ may be set to 0 mg/cm$^2$ to 1.1 mg/cm$^2$, and $T_F$ may be set to 5.0 mg/cm$^2$ to 48 mg/cm$^2$.

The method may further include a drying step of drying the treatment agent applied in the treatment agent applying step if the recording medium is the fabric, wherein:

the treatment agent applying step, the drying step, and the image printing step may be carried out in this order; and an application amount ($T_F$) of the treatment agent per unit area of the fabric may be set to 5.0 mg/cm$^2$ to 48 mg/cm$^2$ in the treatment agent applying step.

The method may further include a drying step of drying the treatment agent applied in the treatment agent applying step if the recording medium is the fabric, wherein:

the treatment agent applying step, the image printing step, and the drying step may be carried out in this order; and an application amount ($T_F$) of the treatment agent per unit area of the fabric may be set to 5.0 mg/cm$^2$ to 34 mg/cm$^2$ in the treatment agent applying step.

In the image printing step and the treatment agent applying step, a discharge amount (I) per unit area of the water-based ink and an application amount (T) per unit area of the treatment agent may be set so that T/I=0 to 0.92 and I+T<2.3 mg/cm$^2$ are fulfilled if the recording medium is the recording paper, or T/I>3.1 is fulfilled if the recording medium is the fabric.

The treatment agent may contain a cationic substance.

A blending amount of the cationic substance with respect to an entire amount of the treatment agent may be 1% by weight to 15% by weight.

The cationic substance may contain at least one of a cationic polymer and cationic inorganic fine particles.

The cationic polymer may include a urethane structure.

A weight average molecular weight of the cationic polymer including the urethane structure may be 1000 to 500000.

A weight average molecular weight of the cationic polymer including the urethane structure may be 3000 to 500000.

A ratio of occupation of a urethane structure portion may be not less than 10% by weight in the cationic polymer including the urethane structure.

A ratio of occupation of a urethane structure portion may be not less than 20% by weight in the cationic polymer including the urethane structure.

The cationic polymer including the urethane structure may include at least one of an acrylic structure and a styrene structure at a portion other than the urethane structure.

The cationic polymer including the urethane structure may include an acrylic structure at a portion other than the urethane structure.

The cationic polymer including the urethane structure may be an emulsion.

In the cationic polymer including the urethane structure, the urethane structure may be obtained from aliphatic isocyanate and polyether-based polyol or polyester-based polyol.

A minimum film formation temperature of the cationic polymer may be not more than 25° C.

In the drying step, a drying temperature may be 100° C. to 250° C.

In the drying step, a weight of the treatment agent applied in the treatment agent applying step may be decreased to be not more than 50% of an amount of application of the treatment agent provided upon application.

In the drying step, the weight of the treatment agent applied in the treatment agent applying step may be decreased to be not more than 30% of the amount of application of the treatment agent provided upon application.

The method may further include a washing step of washing the fabric with water if the recording medium is the fabric, wherein:

the treatment agent applying step, the drying step, the image printing step, and the washing step may be carried out in this order.

An ink-jet recording apparatus used for the image forming method explained above may include:

an ink set accommodating unit, an ink discharge mechanism, and a treatment agent applying mechanism, wherein:

the water-based ink and the treatment agent are accommodated in the ink set accommodating unit;

the water-based ink is discharged onto the recording medium by means of the ink-jet discharge mechanism; and the treatment agent can be applied to the recording medium by means of the treatment agent applying mechanism.

The apparatus may further include a control mechanism (controller), wherein the control mechanism may control discharge performed by the ink discharge mechanism and application performed by the treatment agent applying mechanism.

The apparatus may further include a drying mechanism, wherein the drying mechanism may dry the recording medium after the treatment agent is applied.

As described above, according to the image forming method of the present teaching, it is possible to improve the fastness against water in relation to the printed matter formed on the fabric and it is possible to form the image on the recording paper as well. The way of use of the image forming method of the present teaching is not specifically limited, which is widely applicable to the image formation on a variety of recording media.

What is claimed is:

1. An image forming method using an apparatus for forming an image on both recording media of fabric and recording paper, the image forming method comprising:

applying a treatment agent to the recording paper, wherein an application amount ($T_P$) of the treatment agent per unit area of the recording paper is 0 mg/cm$^2$ to 1.1 mg/cm$^2$;

discharging a water-based ink onto the recording paper by an ink-jet system;

applying the treatment agent to the fabric, the treatment agent coagulating the water-based ink or increasing viscosity of the water-based ink; and discharging the water-based ink onto the fabric by an ink-jet system, the water-based ink being identical to the water-based ink used for forming the image on the recording paper;

wherein an application amount ($T_F$) of the treatment agent per unit area of the fabric is larger than an application amount ($T_P$) of the treatment agent per unit area of the recording paper;

a ratio ($T_P/I_P$) of the application amount ($T_P$) of the treatment agent per unit area of the recording paper to a discharge amount ($I_P$) of the water-based ink per unit area of the recording paper is 0 to 0.92 and a total amount ($I_P+T_P$) of the discharge amount and the application amount is less than 2.3 mg/cm$^2$; and a ratio ($T_F/I_F$) of the application amount ($T_F$) of the treatment agent per unit area of the fabric to the discharge amount ($I_F$) of the water-based ink per unit area of the fabric is larger than 3.1.

2. The image forming method according to claim 1, wherein the water-based ink is a chromatic color ink.

3. The image forming method according to claim 2, wherein the chromatic color ink contains at least one of a direct dye and an acid dye.

4. The image forming method according to claim 1, wherein:

an application amount ($T_F$) of the treatment agent per unit area of the fabric is 5.0 mg/cm$^2$ to 48 mg/cm$^2$.

5. The image forming method according to claim 1, further comprising drying the treatment agent applied to the fabric, wherein:

the application of the treatment agent to the fabric, the drying of the treatment agent applied to the fabric, and the discharge of the water-based ink onto the fabric are carried out in this order; and an application amount ($T_F$) of the treatment agent per unit area of the fabric is 5.0 mg/cm$^2$ to 48 mg/cm$^2$.

6. The image forming method according to claim 1, further comprising drying the treatment agent applied to the fabric, wherein:

the application of the treatment agent to the fabric, the discharge of the water-based ink onto the fabric, and the drying of the treatment agent applied to the fabric are carried out in this order; and an application amount ($T_F$) of the treatment agent per unit area of the fabric is 5.0 mg/cm$^2$ to 34 mg/cm$^2$.

7. The image forming method according to claim 1, wherein the treatment agent contains a cationic substance.

8. The image forming method according to claim 7, wherein a blending amount of the cationic substance to an entire amount of the treatment agent is 1% by weight to 15% by weight.

9. The image forming method according to claim 7, wherein the cationic substance contains at least one of a cationic polymer and cationic inorganic fine particles.

10. The image forming method according to claim 9, wherein the cationic polymer includes a urethane structure.

11. The image forming method according to claim 1, further comprising drying the treatment agent applied to the fabric at a drying temperature of 100° C. to 250° C.

12. The image forming method according to claim 1, further comprising drying the treatment agent applied to the fabric, wherein in the drying of the treatment agent, an amount of the treatment agent in the fabric is decreased to be not more than 50% by weight of an application amount of the treatment agent to the fabric.

13. The image forming method according to claim 12, wherein in the drying of the treatment agent, the amount of the treatment agent in the fabric is decreased to be not more than 30% by weight of the application amount of the treatment agent to the fabric.

14. The image forming method according to claim 1, further comprising: drying the treatment agent applied to the fabric, and washing the fabric with water, wherein the application of the treatment agent to the fabric, the drying of the treatment agent applied to the fabric, the discharge of the water-based ink onto the fabric, and the washing of the fabric are carried out in this order.

15. An ink-jet recording apparatus used for the image forming method as defined in claim 1, the ink-jet recording apparatus comprising:

an ink set accommodating unit which accommodates an ink set including the water-based ink and the treatment agent;

an ink-jet head constructed to discharge the water-based ink onto the recording medium; and a treatment agent applying mechanism constructed to apply the treatment agent to the recording medium.

16. An image forming method for forming an image on a recording medium, comprising:

preparing the recording medium which is fabric or recording paper; and determining whether a first recording mode or a second recording mode is executed;

in the first recording mode, discharging a first discharge amount ($I_F$) of a water-based ink per unit area onto the fabric by an ink-jet system; and in the second recording mode, discharging a second discharge amount ($I_P$) of the water-based ink per unit area onto the recording paper by the ink-jet system, the water-based ink being identical to the water-based ink in the first recording mode, wherein the preparation of the recording medium includes:

selecting the fabric or the recording paper;

when the fabric is selected, applying a first application amount ($T_F$) of a treatment agent per unit area to the fabric, the treatment agent coagulating the water-based ink or increasing viscosity of the water-based ink;

when the recording paper is selected, selecting whether or not the treatment agent is applied to the recording paper; and when the application of the treatment agent to the recording paper is selected, applying a second application amount ($T_P$) of the treatment agent per unit area to the recording paper, the second application amount ($T_P$) being smaller than the first application amount ($T_F$) wherein a ratio ($T_P/I_P$) of the application amount ($T_P$) of the treatment agent per unit area of the recording paper to a discharge amount ($I_P$) of the water-based ink per unit area of the recording paper is 0 to 0.92 and a total amount ($I_P+T_P$) of the discharge amount and the application amount is less than 2.3 mg/cm$^2$; and a ratio ($T_F/I_F$) of the application amount ($T_F$) of the treatment agent per unit area of the fabric to the discharge amount ($I_F$) of the water-based ink per unit area of the fabric is larger than 3.1.

17. The image forming method according to claim 16, wherein when the fabric is selected in the selection of the fabric or the recording paper, the preparation of the recording medium further includes drying the treatment agent applied to the fabric.

18. The image forming method according to claim 16, further comprising washing the fabric with water after discharging the water-based ink onto the fabric in the first recording mode.

* * * * *